US009308632B2

(12) United States Patent
Junkers et al.

(10) Patent No.: US 9,308,632 B2
(45) Date of Patent: Apr. 12, 2016

(54) APPARATUS FOR TIGHTENING OR LOOSENING FASTENERS

(75) Inventors: John K. Junkers, Saddle River, NJ (US); Peter Koppenhoefer, Portland, PA (US); Calvin A. Bonas, Bronx, NY (US)

(73) Assignee: HYTORC Division UNEX Corporation, Mahwah, NJ (US)

( * ) Notice: Subject to any disclaimer, the term of this patent is extended or adjusted under 35 U.S.C. 154(b) by 0 days.

(21) Appl. No.: 13/265,707

(22) PCT Filed: Apr. 23, 2010

(86) PCT No.: PCT/US2010/032139

§ 371 (c)(1), (2), (4) Date: Oct. 21, 2011

(87) PCT Pub. No.: WO2010/124150

PCT Pub. Date: Oct. 28, 2010

(65) Prior Publication Data

US 2012/0090864 A1 Apr. 19, 2012

Related U.S. Application Data

(63) Continuation-in-part of application No. 12/428,200, filed on Apr. 22, 2009, now abandoned, and a continuation-in-part of application No. 12/574,784, filed on Oct. 7, 2009, now abandoned.

(60) Provisional application No. 61/267,694, filed on Dec. 8, 2009.

(51) Int. Cl.

| | |
|---|---|
| ***B25B 21/00*** | (2006.01) |
| ***B25B 23/00*** | (2006.01) |
| ***B25B 23/14*** | (2006.01) |

(52) U.S. Cl.

CPC ..... *B25B 23/0078* (2013.01); *B25B 21/00* (2013.01); *B25B 21/002* (2013.01); *B25B 21/005* (2013.01); *B25B 23/14* (2013.01)

(58) Field of Classification Search

CPC .... B24B 23/026; B25B 21/005; B25B 21/00; B25B 23/145; B25F 5/00; B25F 5/001; E21B 3/02

USPC ..... 173/170, 171, 176, 218; 81/57.22, 81/57.39

See application file for complete search history.

(56) References Cited

U.S. PATENT DOCUMENTS

| | | | | |
|---|---|---|---|---|
| 3,965,778 | A * | 6/1976 | Aspers et al. | 81/470 |
| 4,387,611 | A * | 6/1983 | Junkers | 81/57.36 |
| 4,432,256 | A * | 2/1984 | Aparicio et al. | 81/57.39 |
| 6,152,243 | A * | 11/2000 | Junkers | 173/176 |
| 7,146,880 | B1 * | 12/2006 | Francis et al. | 81/57.39 |

* cited by examiner

*Primary Examiner* — Nathaniel Chukwurah
(74) *Attorney, Agent, or Firm* — Justin B. Bender, Esq.

(57) ABSTRACT

Apparatus for tightening or loosening fasteners pneumatically, electrically, hydraulically and manually driven are disclosed, and in one example includes: a receiving member, rotatably supported in the apparatus for tightening or loosening, for receiving the fastener; a device for effecting rotation of the receiving member to tighten or loosen the fastener; and an apparatus which transfers a reaction force during tightening or loosening of the fasteners. The apparatus which transfers a reaction force includes: a first force-transmitting element rotatably attachable about a turning force axis of the device for effecting rotation; and a second force-transmitting element either rotatably attachable about, extensibly and retractably attachable along, or rotatably attachable about and extensibly and retractably attachable along at least a portion of the first element.

7 Claims, 11 Drawing Sheets

APPARATUS FOR TIGHTENING OR LOOSENING FASTENERS

CROSS REFERENCE TO RELATED APPLICATION

This application is a continuation-in-part application of co-pending U.S. application Ser. Nos. 12/428,200, having the Filing Date of Apr. 22, 2009, that is entitled "Reaction Adaptors for Torque Power Tools and Methods of Using the Same", an entire copy of which is incorporated herein by reference; Ser. No. 12/574,784, having the Filing Date of Oct. 7, 2009, that is entitled "Reaction Adaptors for Torque Power Tools and Methods of Using the Same", an entire copy of which is incorporated herein by reference; and 61/267,694, having the Filing Date of Dec. 8, 2009, that is entitled "Apparatus for Tightening or Loosening Fasteners", an entire copy of which is incorporated herein by reference.

BACKGROUND

1. Field of the Technology

The present application relates generally to torque power tools, and more particularly to reaction adaptors for tools, tools having adaptors, and methods of using the same.

2. Description of the Related Art

Torque power tools are known in the art and include those driven pneumatically, electrically, hydraulically, manually, by a torque multiplier, or otherwise powered. All torque power tools have a turning force and an equal and opposite reaction force. Often this requires the use of reaction fixtures to abut against viable and accessible stationary objects to stop the housing of the tool from turning backward, while a fastener, such as for example a nut, turns forward. The stationary object must be viable in that it must be able to absorb the reaction force and be accessible in that it must be nearby for the reaction fixture to abut against it. The reaction fixture may be connected around an axis or the housing, and a mechanism is provided to hold the fixture steady relative to the tool housing during operation. This may be achieved with splines, polygons, or other configurations. Several examples of known torque power tools that include a reaction arm to abut against a stationary object are disclosed in U.S. Pat. Nos. 6,152,243, 6,253,642 and 6,715,881, commonly owned and incorporated by reference herein.

Present reaction fixtures limit tool functionality. Those connected about a turning force axis, on the one hand, allow for complete rotation of a tool housing about the turning force axis without changing the abutment point. On the other hand, they are limited to coaxial abutment against stationary objects. Those connected at the housing, on the one hand, allow for abutment against stationary objects positioned in various circumferential and spatial locations relative to the nut to be turned. On the other hand, they prevent complete rotation of the tool housing about the turning force axis without changing the abutment point.

Adjustability of present reaction fixtures is limited to about a single axis which precludes the use of a single tool in assemblies having viable stationary objects in non-accessible locations. Operators commonly need several tools at a workstation each having a reaction fixture oriented differently to abut against a viable and accessible stationary object. Alternatively, operators must disassemble the tool, reposition the reaction fixture and reassemble the tool. The former solution is expensive while the latter solution is time consuming.

If present reaction fixtures cannot abut against viable and accessible stationary objects properly, custom reaction fixtures need to be engineered. Re-engineering of the tool connection means to accommodate custom reaction fixtures is prohibitively expensive, unsafe and time consuming. Tool manufacturers offer several commercially available reaction fixture constructions for these reasons.

During operation of tools, twisting forces are induced on the housing along the turning force axis by the transfer of the reaction force through the reaction fixture to the stationary object. The reaction force for tools with torque output of 10,000 ft. lbs. can be as high as 40,000 lbs. and is applied as a side load to the stationary object in one direction and to the fastener to be turned in an opposite direction. Large reaction forces bend and increase the turning friction of the fastener.

Twisting forces are limited and least destructive when the reaction force is transferred to a stationary object perpendicular to the turning force axis. The ideal abutment point is perpendicular to the turning force axis and on the same plane as the fastener to be turned. Tools operating with sockets that reach down to the same plane as the fastener cause twisting forces. Twisting forces exacerbate fastener-bending forces roughly by a distance H between the attachment point of the socket to the tool and the fastener plane. These twisting and fastener-bending forces are limited and least destructive when the reaction force is transferred perpendicular to the turning force axis in a plane roughly the distance H above the fastener plane. Thus the ideal abutment pressure point is perpendicular to the turning force axis in the plane distance H above the fastener plane. Rarely do present reaction fixtures transfer the reaction force to the ideal abutment pressure point. Reaction fixtures must be adjustable to minimize twisting and fastener-bending forces so as to avoid the tool from jumping off of the job or from failing.

Present reaction fixtures are not adjustable around multiple axes due to concerns regarding total tool weight. Tools need to be portable for the majority of fasteners. The maximum tool weight to be carried safely by an operator should not exceed 30 lbs. For larger fasteners, the maximum tool weight to be carried safely by two operators should not exceed 60 lbs. For applications where the only viable and accessible stationary object requires custom reaction fixtures, these weights are exceeded and crane use is required. Crane use to support the tool is expensive and is economical only for large fasteners.

Other tools provided with reaction fixtures of the prior art are disclosed, for example, in U.S. Pat. Nos. 3,361,218, 4,549,438, 4,538,484, 4,507,546, 4,619,160, 4,671,142, 4,706,526, 4,928,558, 5,027,932, 5,016,502, 5,142,951, 5,151200, 5,301,574, 5,791,619, 6,260,443.

Accordingly, what are needed are reaction force transfer mechanisms which overcome the deficiencies of the prior art, as well as methods of using the same.

SUMMARY

Reaction adaptors for torque power tools pneumatically, electrically, hydraulically and manually driven, tools having the adaptors, and methods of using the same, are disclosed. In an illustrative example, a first reaction adaptor includes a first force-transmitting element, when engaged with a tool, being rotatable about a turning force axis of the tool; and a second force-transmitting element, when engaged with the first element, being either rotatable about, extensible and retractable along, or rotatable about and extensible and retractable along at least a distal portion of the first element. In another illustrative example, a tool for tightening or loosening a fastener includes the first reaction adaptor.

In another illustrative example, a second reaction adaptor of an apparatus for tightening or loosening a fastener includes: a first force-transmitting element attachable to a reaction support portion of the apparatus; a second force-transmitting element slidably attachable to the first element; and wherein the second adaptor is adjustable to abut against a stationary object.

Advantageously, the first element is engageable and attachable separately, individually and independently to the tool and the second element is engageable and attachable separately, individually and independently to the first element. Portability of the tool is maximized while weight of the tool is minimized. Commercially available reaction fixtures may be used with or in replacement of portions of the first and second elements, rather than custom reaction fixtures, thereby reducing costs and increasing safety. The reaction adaptor is adjustable to minimize twisting and fastener-bending forces so as to avoid the tool from jumping off of the job or from failing. The reaction adaptor, when engaged with the tool, is adjustable to surround, engage or abut against viable fasteners or stationary objects at the ideal abutment pressure point. The reaction adaptor, when attached to the tool, may transfer the reaction force to the ideal abutment pressure point during operation. Operators no longer need several tools at the workstation each having a reaction fixture oriented differently to abut against viable stationary objects for each application. Nor do operators need to completely disassemble the tool, reposition the reaction adaptor and reassemble the tool for each application.

In another illustrative example, an apparatus for tightening or loosening fasteners includes: a first and a second receiving member, rotatably supported in the apparatus, for receiving a first and a second fastener; a first and a second device for effecting rotation of the respective receiving members to tighten or loosen the respective fasteners; and a device for controlling an operation parameter of the respective devices for effecting rotation to maintain a difference in the operation parameters within a predetermined value.

Advantageously, inadvertent injury to the operator; bolt load variances caused by frictional differences from one fastener to another; fastener bending and thread galling from nonsymmetrical absorption of the side load; and fastener replacement caused by fastener bending and thread galling are substantially decreased. The reaction forces from the apparatus substantially cancel themselves out at the ideal abutment pressure point. And the portability of the apparatus is increased. Furthermore the ability to simultaneously tighten or loosen two fasteners increases efficiency and productivity.

BRIEF DESCRIPTION OF THE DRAWINGS

For a fuller understanding of the nature and advantages of the present application, as well as the preferred mode of use, reference should be made to the following detailed description read in conjunction with the accompanying drawings.

DETAILED DESCRIPTION OF THE PREFERRED EMBODIMENTS

The following descriptions incorporate the best embodiments presently contemplated for carrying out the present application. This description is made for the purpose of illustrating the general principles of the present application and is not meant to limit the inventive concepts claimed herein.

Figure 1:
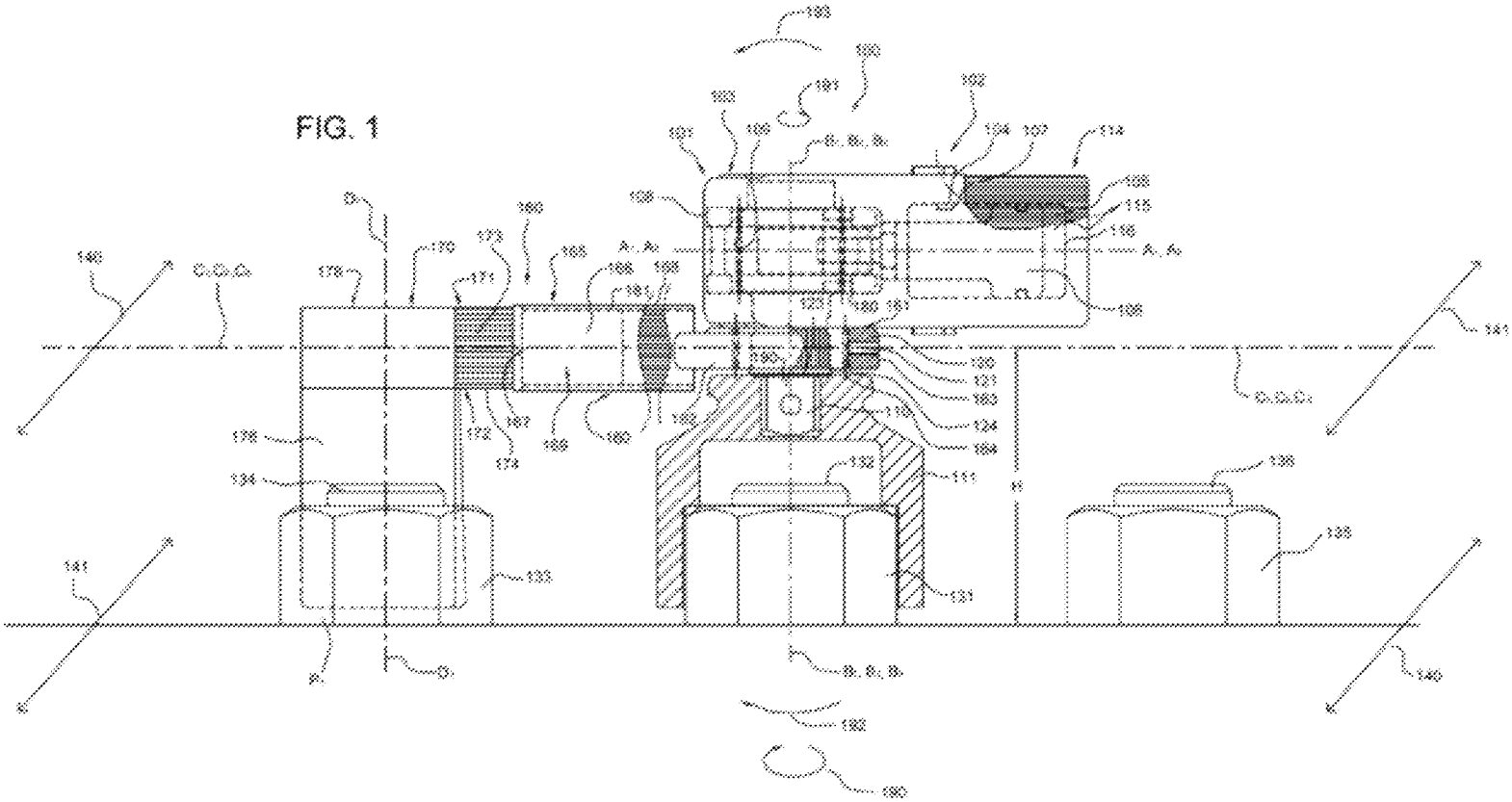
FIG. 1 is a side view of an exemplary embodiment of a reaction adaptor for a torque power tool and the tool having the reaction adaptor of the present application.
Figure 2:
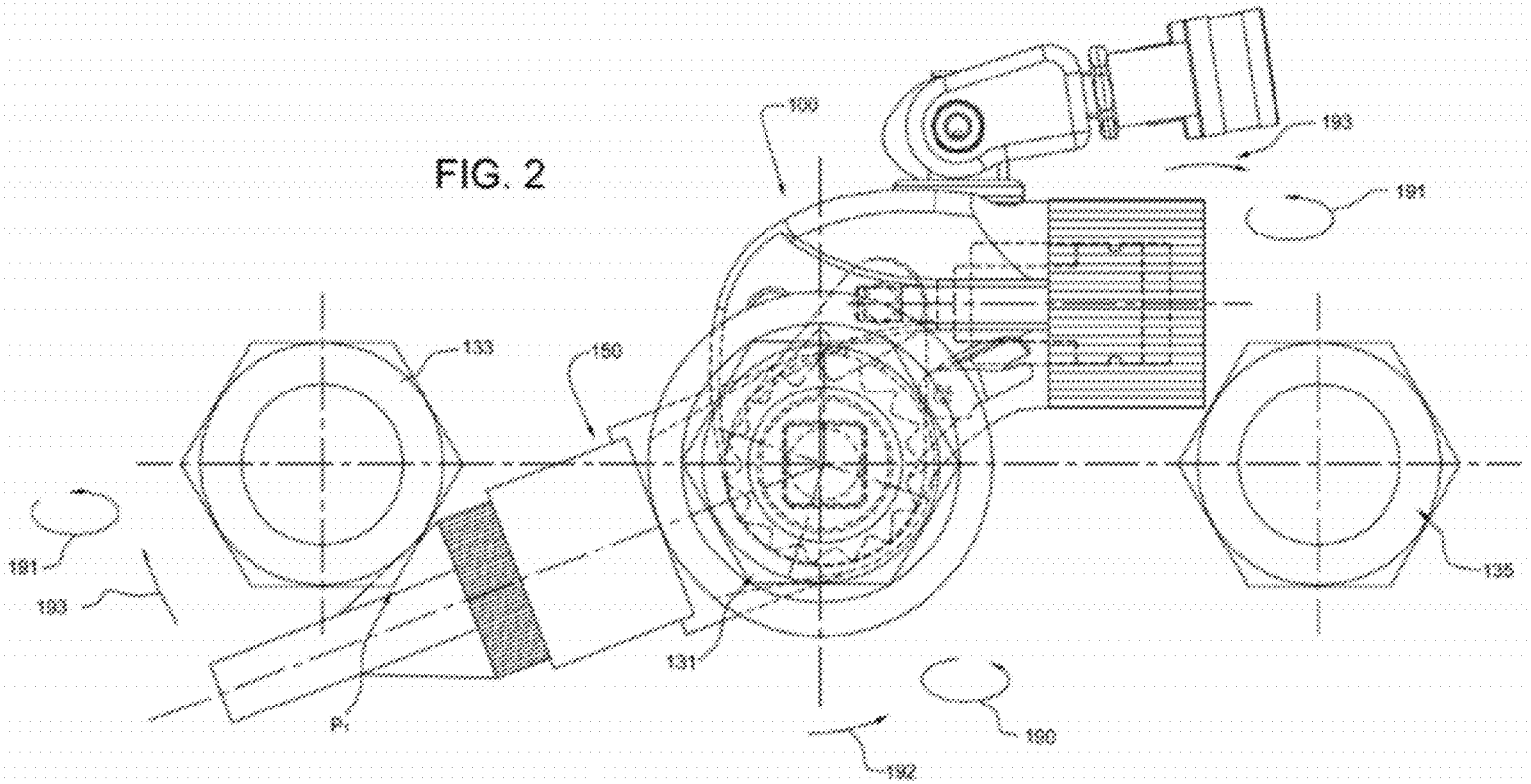
FIG. 2 is a plan view FIG. 1.

An Exemplary Embodiment of a Reaction Adaptor for a Torque Power Tool and the Tool Having the Reaction Adaptor. FIG. 1 shows a side view of an exemplary embodiment of a reaction adaptor 150 for a torque power tool 100. FIG. 2 is a plan view of FIG. 1. Tool 100 includes a housing 101 having two housing portions, a cylinder portion 102 and a driving portion 103.

Cylinder-piston means 104 are arranged in cylinder portion 102 and include a cylinder 105, a piston 106 reciprocatingly movable in cylinder 105 along a piston axis $A_1$, and a piston rod 107 connected with piston 106. A known lever-type ratchet mechanism 108 is arranged in driving portion 103, connected to and drivable by cylinder-piston means 104, and includes a ratchet 109. Ratchet 109 turnable about a turning, force axis $B_1$ which is perpendicular to piston axis $A_1$. Ratchet 109 is connected with a driving element 110 which receives a first turning force 190 acting about turning force axis $B_1$ in one direction 192 during operation of tool 100 (see also FIG. 2). Turning force 190 turns a hex socket 111 attached to driving element 110 which turns a nut 131.

A reaction support portion 114, formed on a part of cylinder portion 103 receives second turning force 191 acting about turning force axis $B_1$ in another direction 193 during operation of tool 100. Reaction support portion 114 is formed of an annular polygonal body 115 having a plurality of outer splines 116. Outer splines 116 are positioned circumferentially around annular body 115 and extend radially outwardly from a central axis $A_2$ which is coaxial with piston axis $A_1$.

A reaction support portion 120, connected to driving portion 103, also receives second turning force 191 acting about turning force axis $B_1$ in another direction 193 during operation of tool 100. Reaction support portion 120 is formed of an annular polygonal body 121 having a plurality of outer splines 123. Outer splines 123 are positioned circumferentially around annular body 121 and extend radially outwardly from a central axis $B_2$ which is coaxial with turning force axis $B_1$.

Reaction adaptor 150, when attached to reaction support portion 120, receives second turning force 191 acting in another direction 193 during operation. First and second turning forces 190 and 191 are equal to and in opposite directions to each other. First turning force 190 turns fastener 131 while reaction adaptor 150 transfers second turning force 191 to a stationary object at abutment pressure point $P_1$, in this case, a neighboring nut 133.

Reaction adaptor 150 generally includes a first force-transmitting element 160, when engaged with tool 100, being rotatable about turning force axis $B_1$; and a second force-transmitting element 170, when engaged with first element 160, being one of rotatable about, extensible and retractable along, and rotatable about and extensible and retractable along at least a distal portion 165 of first element 160. First element 160 includes a proximal portion 161 formed of an annular polygonal body 162 having a plurality of inner splines 163, and distal portion 165 formed of a tubular member 166 having an internal bore 167 with a plurality of inner splines 168. Second element 170 includes a proximal portion 171 formed of a tubular member 172 having a plurality of outer splines 173, and a distal portion 175 formed of a rectangular body 176. First element 160, when attached to tool 100, extends substantially perpendicular to and has a first force-transmitting axis $C_1$ substantially perpendicular to turning force axis $B_1$. Second element 170, when attached to first element 160, extends substantially perpendicular to and has a second force-transmitting axis $D_1$ substantially perpendicular to first force-transmitting axis $C_1$.

First element 160 is shown non-rotatably attached to reaction support portion 120 in a first position and held in place by a locking mechanism 180. First element 160 is engageable and attachable separately, individually, and independently to tool 100. Inner splines 163 are positioned circumferentially around the inside of annular body 162 and extend radially inwardly toward a central axis $B_3$. Annular body 162 is of such inner width and annular body 121 is of such outer width that inner splines 163 mesh with outer splines 123. Annular body 121 and proximal portion 161 include first and second connecting means 124 and 164. Reaction support portion 120 and first element 160 are attachable to each other by attaching first and second connecting means 124 and 164. Locking mechanism 180 may include a bore and pin or other well known configuration like a spring loaded reaction clamp at the base of reaction support portion 120 and receiving grooves on proximal portion 161. Axes $B_1$, $B_2$, and $B_3$ are coaxial when first element 160 and reaction support portion 120 are attached to each other and to tool 100.

Second element 170 is shown non-rotatably attached to first element 160 in a second position and held in place by a locking mechanism 181. Second element 170 is engageable and attachable separately, individually, and independently to first element 160. Inner splines 168 are positioned circumferentially around the inside of internal bore 167 and extend radially inwardly toward a central axis $C_2$. Outer splines 173 are positioned circumferentially around tubular member 172 and extend radially outwardly from a central axis $C_3$. Internal bore 167 is of such inner width and tubular member 172 is of such outer width that inner splines 168 mesh with outer splines 173. Internal bore 167 receives tubular member 172 in a telescoping arrangement. Distal portion 165 includes third connecting means 169 which comprises tubular member 166, internal bore 167, and inner splines 168. Proximal portion 171 includes fourth connecting means 174 which comprises tubular member 172 and outer splines 173. First and second elements 160 and 170 are attachable to each other by attaching third and fourth connecting means 169 and 174 which are held in place by locking mechanism 181. Locking mechanism 181 may include a bore and pin or other well known configuration like a spring loaded reaction clamp on distal portion 165 and receiving grooves on proximal portion 171. Axes $B_1$, $B_2$, and $B_3$ are coaxial and $C_1$, $C_2$, and $C_3$ are coaxial when second element 170, first element 160 and reaction support portion 120 are attached to each other and to tool 100. Rectangular body 176 of distal portion 175 as shown extends substantially perpendicular to tubular member 172 and first element 160.

Tool 100 is prepared to turn nut 131 threaded on a lug 132 to connect flanges (not shown). Reaction adaptor 150 is attached to tool 100 in a reaction force transfer position to transfer turning force 191, the reaction force, to nut 133 at abutment pressure point $P_1$ during operation. As turning force 190 turns hex socket 111 on nut 131, rectangular body 176, supported by distal portion 175, bears against abutment pressure point $P_1$ on the walls of nut 133. This prevents ratchet 109 from rotating inwardly relative to nut 131. Thus nut 131 is turned by hex socket 111 to a desired torque.

Nut 131 to be turned is located in the center, abutment pressure point $P_1$ for reaction adaptor 150 is arranged left of center, and nut 135 is arranged right of center. Since action and reaction are equal but opposite, reaction adaptor 150 pushes its abutment area backwards from the center (see FIG. 2). Side loads applied to driving portion 103 are reduced but not eliminated.

Figure 3:
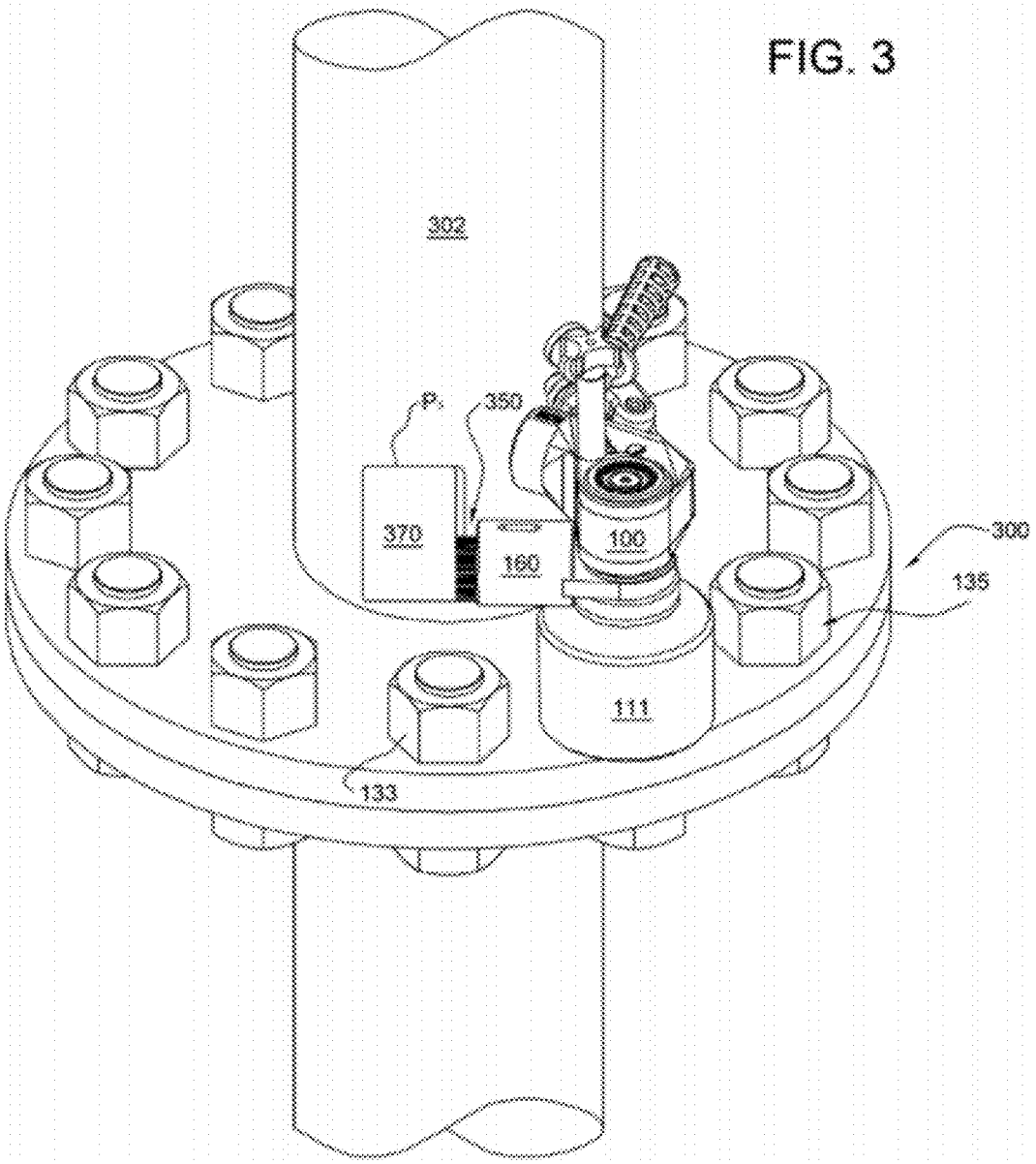
FIG. 3 is a three-dimensional view of FIG. 1 having the reaction adaptor adjusted to abut against a stationary object about a pipe flange.

FIG. 3 is a three-dimensional view of FIG. 1 having a reaction adaptor 350 abutted against a piping segment 302 of a pipe flange 300. Reaction adaptor 350 is similar to reaction adaptor 150 of FIGS. 1-2 in all material ways except that second element 370 has been rotated counterclockwise to abut against piping segment 302 at an abutment pressure point $P_3$. As discussed previously, tool 100 operates with hex socket 111 which reaches down to a fastener plane 141. Twisting forces exacerbate fastener-bending forces by a distance H roughly between the attachment point of socket 111 to tool 100 at plane 140 and fastener plane 141 (see FIG. 1). In this embodiment, axes $C_1$, $C_2$, $C_3$ and $D_1$ lie in plane 140 at distance H above plane 141. The twisting and fastener-bending forces are limited and least destructive when turning force 191, the reaction force, is transferred perpendicular to turning force axis $B_1$ in plane 140. Thus the ideal abutment pressure point $P_3$ for reaction adaptor 350 is perpendicular to turning force axis $B_1$ in plane 140.

Advantageously, first element 160 is engageable and attachable separately, individually and independently to tool 100 and second element 170 is engageable and attachable separately, individually and independently to first element 160. The portability of tool 100 is maximized while the weight of tool 100 is minimized. Commercially available reaction fixtures may be used with or in replacement of portions of first and second elements 160 and/or 170, rather than custom reaction fixtures, thereby reducing costs and increasing safety. Reaction adaptor 150 is adjustable to minimize twisting and fastener-bending forces so as to avoid tool 100 from jumping off of the job or from failing. Reaction adaptor 150, when engaged with tool 100, is adjustable to abut against viable and otherwise inaccessible stationary objects at the ideal abutment pressure point P. Reaction adaptor 150, when attached to tool 100, transfers turning force 191 to at the ideal abutment pressure point $P_3$ during operation. Operators no longer need several tools at the workstation each having a reaction fixture oriented differently to abut against viable stationary objects for each application. Nor do operators need to completely disassemble tool 100, reposition reaction adaptor 150 and reassemble tool 100 for each application. Also, reaction adaptor 150 allows for complete rotation of housing 101 about turning force axis $B_1$ without changing abutment point $P_3$ thereby avoiding any circumferential obstructions in a rotation plane of housing 101.

Figure 4:
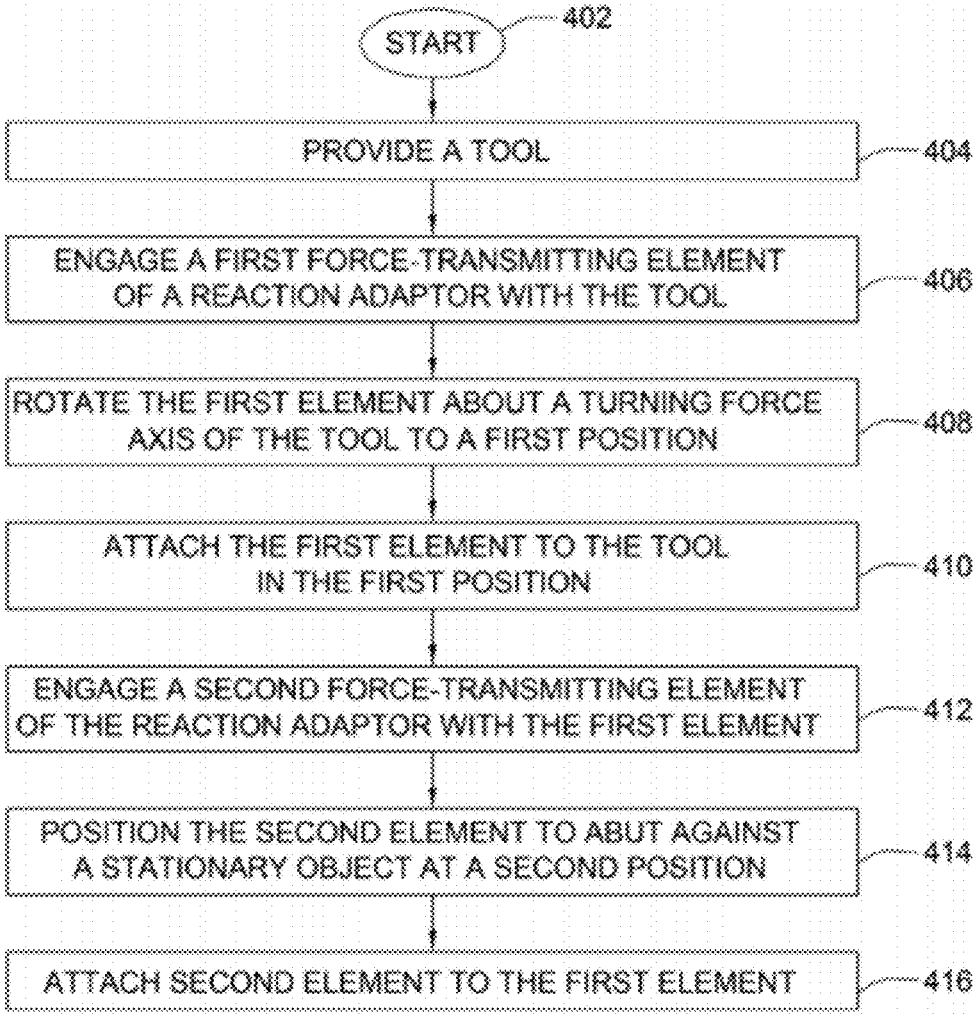
FIG. 4 is a flowchart which describes an exemplary method of using the reaction adaptor and the tool having the reaction adaptor.

An Exemplary Method of Using the Reaction Adaptor and the Tool Having the Reaction Adaptor. FIG. 4 is a flowchart which describes an exemplary method of using the reaction adaptor and the tool having, the reaction adaptor FIGS. 1-3 will be referenced with the flowchart steps of FIG. 4.

Beginning with step 404 of FIG. 4, tool 100 is provided by providing housing 101 having cylinder portion 102 and driving portion 103; arranging, in cylinder portion 102, cylinder-piston means 104 movable along piston axis $A_1$; arranging, in driving portion 103, ratchet mechanism 108 connected to and drivable by cylinder-piston means 104; providing, in ratchet mechanism 108, ratchet 109 turnable about turning force axis B which is perpendicular to piston axis $A_1$; and providing driving element 110, connected to ratchet 109, receiving first turning force 190 acting about turning force axis $B_1$ in one direction 192 during operation of tool 100.

Next, in step 406 of FIG. 4, first element 160 is engaged with tool 100 by bringing proximal portion 161 substantially adjacent to reaction support portion 120 and substantially aligning axes $B_1$, $B_2$, and $B_3$. Annular body 162 is passed over driving element 110.

In step 408 of FIG. 4, first element 160 is rotated about turning force axis $B_1$ to a first position. The first position is chosen based on the proximity of a viable and accessible stationary object that may be found in various circumferential and spatial locations relative to nut 131. First element 160, when engaged with tool 100, is rotatable about turning force axis $B_1$ because inner splines 163 and outer splines 123 have not yet been meshed.

In step 410 of FIG. 4, first element 160 is attached to reaction support portion 120 in the first position by meshing inner splines 163 and outer splines 123 and activating locking mechanism 180. In steps not shown in FIG. 4, hex socket 111 is attached to driving element 110, and tool 100 is placed on nut 131.

In step 412 of FIG. 4, second element 170 is engaged with first element 160 by bringing proximal portion 171 substantially adjacent to distal portion 165 and substantially aligning axes $C_1$, $C_2$, and $C_3$.

In step 414 of FIG. 4, second element 170 is positioned to abut against the stationary object in a second position by rotating it about and then retracting it along distal portion 165. The second position is chosen based on the proximity of the viable and accessible stationary object. Second element 170, when engaged with first element 160, is rotatable about distal portion 165 because inner splines 168 have not yet been meshed with outer splines 173. Second element 170 is rotated about distal portion 165 to one of a plurality of extension angles; inner splines 168 and outer splines 173 are meshed when internal bore 167 receives tubular member 172 in a telescoping arrangement; and second element 170 is retracted along distal portion 165 to one of a plurality of extension lengths. Reaction adaptor 150, in the second position, abuts against the viable and accessible stationary object, nut 133. In step 416 of FIG. 4, second element 170 is attached to first element 160 in the second position by activating locking mechanism 181. Reaction adaptor 150 is now in reaction force transfer position.

When necessary to disassemble tool 100 or adjust reaction adaptor 150 to another abutment pressure point, second element 170 is detached from first element 160 by deactivating locking mechanism 181. Second element 170 is extended along distal portion 165 until inner splines 168 and outer splines 173 are no longer meshed and second element 170 is no longer substantially adjacent first element 160. Tool 100 may be displaced from nut 131 and hex socket 111 may be detached from driving element 110. First element 160 is detached from reaction support portion 120 by deactivating locking mechanism 180, unmeshing inner splines 163 and outer splines 123, and removing it from reaction support portion 120. The steps of FIG. 4 are then repeated.

In an alternative method of using the reaction adaptor and the tool having the reaction adaptor, the second element is engaged with the first element prior to the first element being engaged with the tool. The reaction adaptor is fully assembled and pre-adjusted and may be abutted against a viable and accessible stationary object prior to being engaged with the tool.

Alternative Structures of the First and Second Connecting Means. Reaction support portion 120 may have a height such that first element 160, when engaged with reaction support portion 120, is also slideable along reaction support portion 120. Distance H and thus plane 140 may be varied by sliding first element 160 along reaction support portion 120.

Proximal portion 161 may have a hinged annular body 162 such that annular body 162 is not passed over driving element 110 in step 406 of FIG. 4. First element 160 is engaged with tool 100 by bringing proximal portion 161 substantially adjacent to reaction support portion 120, unhinging annular body 162, and substantially aligning axes $B_1$, $B_2$, and $B_3$. Note that a similar structure may be used for other tool and reaction adaptor components.

Figure 5A:
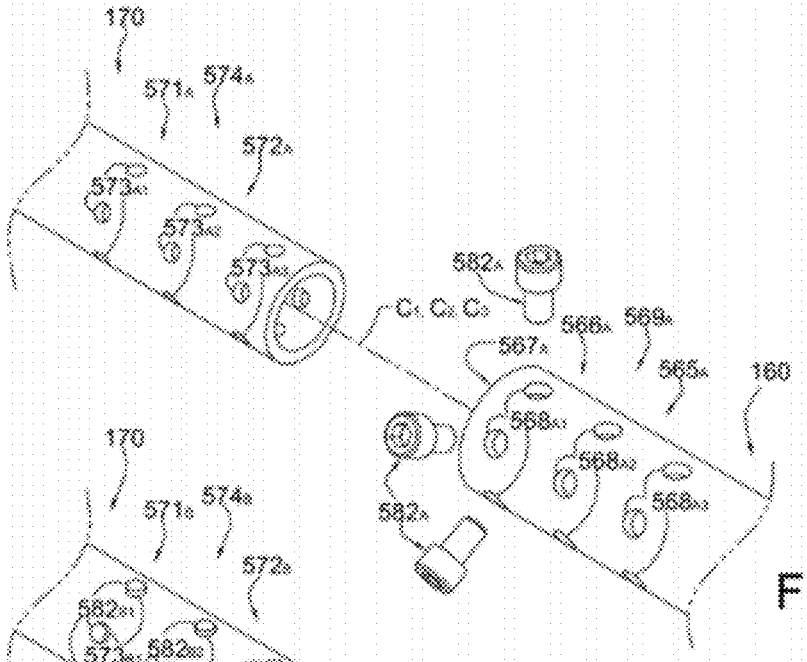
FIGS. 5A-5C are perspective views of alternative embodiments of a third and a fourth connecting means of a first and a second force-transmitting element and a fourth connecting means of a second force-transmitting element of the reaction adaptor including bores and threaded nuts, bores and detents, and polygonal configurations.
Figure 5B:
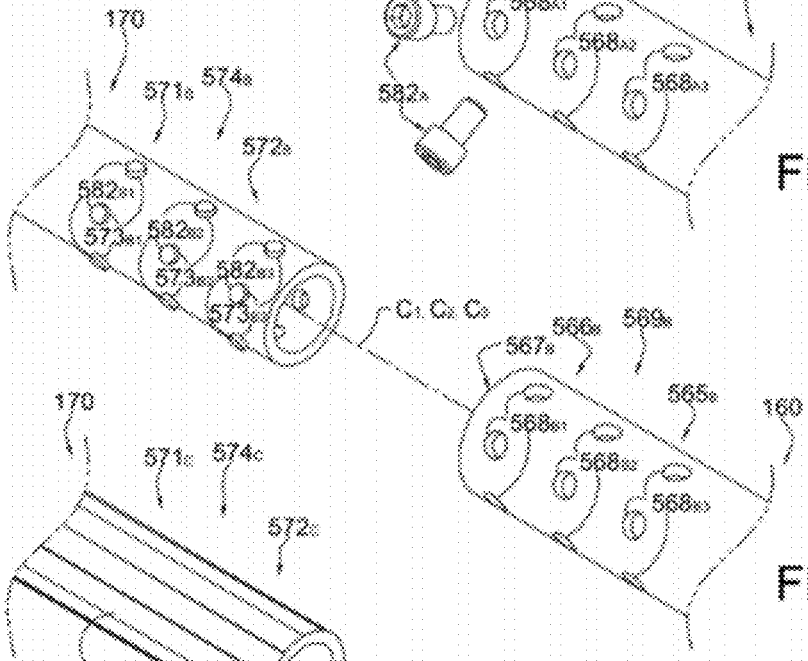
Figure 5C:
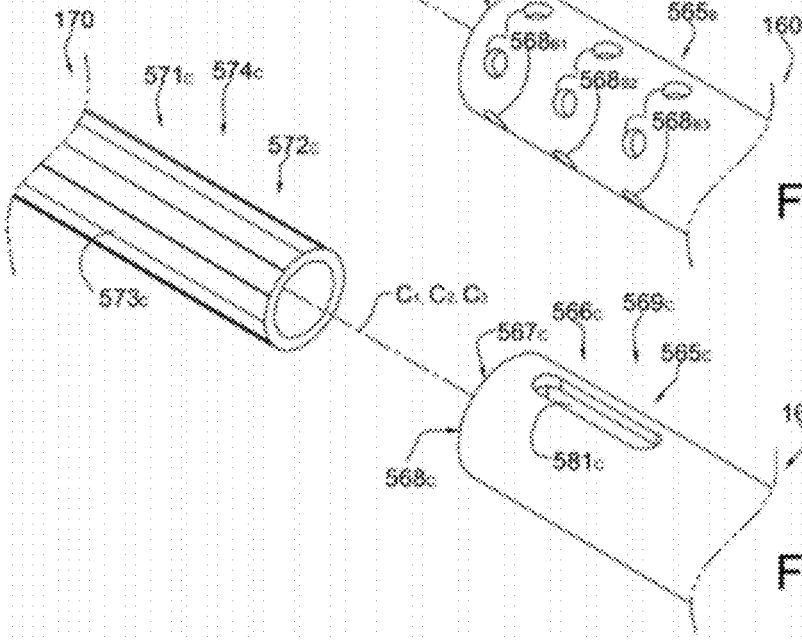

Alternative Structures of the Third and Fourth Connecting Means. FIGS. 5A-5C are perspective views of alternative structures of the third and fourth connecting means of the first and second elements including bores and threaded nuts, bores and detents, and polygonal configurations. Referring back to FIGS. 1-4, distal portion 165 and proximal portion 171 include third and fourth connecting means 169 and 174 which are splined configurations. First and second elements 160 and 170 are attachable to each other by attaching third and fourth connecting means 169 and 174.

FIG. 5A is a perspective view of a second structure of a third and fourth connecting means $\mathbf{569}_A$ and $\mathbf{574}_A$. Generally discussion related to FIGS. 1-3 applies to FIG. 5A. A portion of distal portion $\mathbf{565}_A$ of first element 160 is shown formed of a tubular member $\mathbf{566}_A$ having an internal bore $\mathbf{567}_A$ and at least three sets of a plurality of radially directed, circumferentially spaced, threaded-through bores $\mathbf{568}_{A1}$, $\mathbf{568}_{A2}$, and $\mathbf{568}_{A3}$. A portion of proximal portion $\mathbf{571}_A$ of second element 170 is shown formed of a tubular member $\mathbf{572}_A$ having at least three sets of a plurality of radially directed, circumferentially spaced, inwardly tapered attachment bores $\mathbf{573}_{A1}$, $\mathbf{573}_{A2}$, and $\mathbf{573}_{A3}$, so as to operatively engage with first element 160. Bore sets $\mathbf{568}_{A1}$-$\mathbf{568}_{A3}$, are of such size as to receive a threaded end of threaded bolts 582 and bore sets $\mathbf{573}_{A1}$-$\mathbf{573}_{A3}$ are of such size so as to receive a tapered end of bolts $\mathbf{582}_A$ at one of a plurality of extension angles and extension lengths. Internal bore $\mathbf{567}_A$ is of such inner width and tubular member $\mathbf{572}_A$ is of such outer width that bore sets $\mathbf{568}_{A1}$-$\mathbf{568}_{A3}$ align with bore sets $\mathbf{573}_{A1}$-$\mathbf{573}_{A3}$. Internal bore $\mathbf{567}_A$ receives tubular member $\mathbf{572}_A$ in a telescoping arrangement. Distal portion $\mathbf{565}_A$ includes third connecting means $\mathbf{569}_A$ which comprises tubular member $\mathbf{566}_A$, internal bore $\mathbf{567}_A$, and bore sets $\mathbf{568}_{A1}$-$\mathbf{568}_{A3}$. Proximal portion $\mathbf{571}_A$ includes fourth connecting means $\mathbf{574}_A$ which includes tubular member $\mathbf{572}_A$ and bore sets $\mathbf{573}_{A1}$-$\mathbf{573}_{A3}$. First and second elements 160 and 170 are attachable to each other by attaching third and fourth connecting means $\mathbf{569}_A$ and $\mathbf{574}_A$.

Generally discussion related to the method of FIG. 4 applies to FIG. 5A. In step 412 of FIG. 4, second element 170 is engaged with first element 160 by bringing proximal portion $\mathbf{571}_A$ substantially adjacent to distal portion 565, substantially aligning axes $C_1$, $C_2$, and $C_3$, and inserting proximal portion 571$_A$ into distal portion 565$_A$ in a telescoping arrangement.

FIG. 56 is a perspective view of a third structure of a third and fourth connecting means 569$_B$ and 574$_B$. Generally discussion related to FIGS. 1-3 applies to FIG. 56. A portion of distal portion 565$_B$ of first element 160 is shown formed of a tubular member 566$_B$ having an internal bore 567$_B$ and at least three sets of a plurality of radially directed circumferentially spaced bores 568$_{B1}$, 568$_{B2}$, and 568$_{B3}$. A portion of proximal portion 571$_B$ of second element 170 is shown formed of a tubular member 572$_B$ having at least three sets of a plurality of radially directed, circumferentially spaced bores 573$_{B1}$-573$_{B3}$. At least three sets of a plurality of detents 582$_{B1}$-582$_{B3}$ project through bore sets 573$_{B1}$-573$_{B3}$ and are biased radially outwardly by spring mechanisms (not shown) so as to operatively engage with first element 160. Bore sets 568$_{B1}$-568$_{B3}$ are of such size as to receive detent sets 582$_{B1}$-582$_{B3}$ at one of a plurality of extension angles and extension lengths. Internal bore 567$_B$ is of such inner width and tubular member 572$_B$ is of such outer width that bore sets 568$_{B1}$-568$_{B3}$ align with bore sets 573$_{B1}$-573$_{B3}$. Internal bore 567$_B$ receives tubular member 572$_B$ in a telescoping arrangement. Distal portion 565$_B$ includes third connecting means 569$_B$ which includes tubular member 566$_B$, internal bore 567$_B$, and bore sets 568$_{B1}$-568$_{B3}$. Proximal portion 571$_B$ includes fourth connecting means 574$_B$ which includes tubular member 572$_B$, bore sets 573$_{B1}$-573$_{B3}$, and detent sets 582$_{B1}$-582$_{B3}$. First and second elements 160 and 170 are attachable to each other by attaching third and fourth connecting means 569$_B$ and 574$_B$.

Generally discussion related to the method of FIG. 4 applies to FIG. 58. In step 412 of FIG. 4, second element 170 is engaged with first element 160 by bringing proximal portion 571$_B$ substantially adjacent to distal portion 565$_B$, substantially aligning axes $C_1$, $C_2$, and $C_3$, and inserting proximal portion 571$_B$ into distal portion 565$_B$ in a telescoping arrangement.

FIG. 5C is a perspective view of a fourth structure of a third and fourth connecting means 569$_C$ and 574$_C$. Generally discussion related to FIGS. 1-3 applies to FIG. 5C. A portion of distal portion 565$_C$ of first element 160 is shown formed of a tubular member 566$_C$ having an internal bore 567$_C$ with a polygonal inner wall 568$_C$ (not shown). A portion of proximal portion 571$_C$ of second element 170 is shown formed of a tubular member 572$_C$ having a polygonal outer wall 573$_C$. Internal bore 567$_C$ is of such inner width and tubular member 572$_C$ is of such outer width that internal bore 567$_C$ receives tubular member 572$_C$ in a telescoping arrangement and polygonal inner wall 568$_C$ meshes with polygonal outer wall 573$_C$ at one of a plurality of extension angles and extension lengths. Distal portion 565$_C$ includes third connecting means 569$_C$ which includes tubular member 566$_C$, internal bore 567$_C$, and polygonal inner wall 568$_C$. Proximal portion 571$_C$ includes fourth connecting means 574$_C$ which includes tubular member 572$_C$ and polygonal outer wall 573$_C$. First and second elements 160 and 170 are attachable to each other by attaching third and fourth connecting means 569$_C$ and 574$_C$.

Generally discussion related to the method of FIG. 4 applies to FIG. 5C. In step 412 of FIG. 4, second element 170 is engaged with first element 160 by bringing, proximal portion 571$_C$ substantially adjacent to distal portion 565$_C$ and substantially aligning axes $C_1$, $C_2$, and $C_3$.

Note that other structures of the third and fourth connecting means may be used including a bores and pins and hinged body configuration.

Alternative Structures of Portions of the First and Second Elements. In the exemplary embodiment of FIGS. 1-3, at least portions of first and second elements 160 and 170 extend perpendicular to each other. Alternatively, at least distal portion 165 of first element 160, when attached to tool 100, may extend substantially at an angle of 45°-135° to turning force axis $B_1$. First force-transmitting axis $C_1$ would be of a similar angle to turning force axis B. Further, at least distal portion 175 of second element 170, when attached to first element 160, may extend substantially collinear to at least distal portion 165. In other structures, at least distal portion 175 of second element 170, when attached to first element 160, may extend substantially at an angle of 45°-135° to at least distal portion 165. Second force-transmitting axis $D_1$ would have similar angle to first force-transmitting axis $C_1$.

Figure 6:
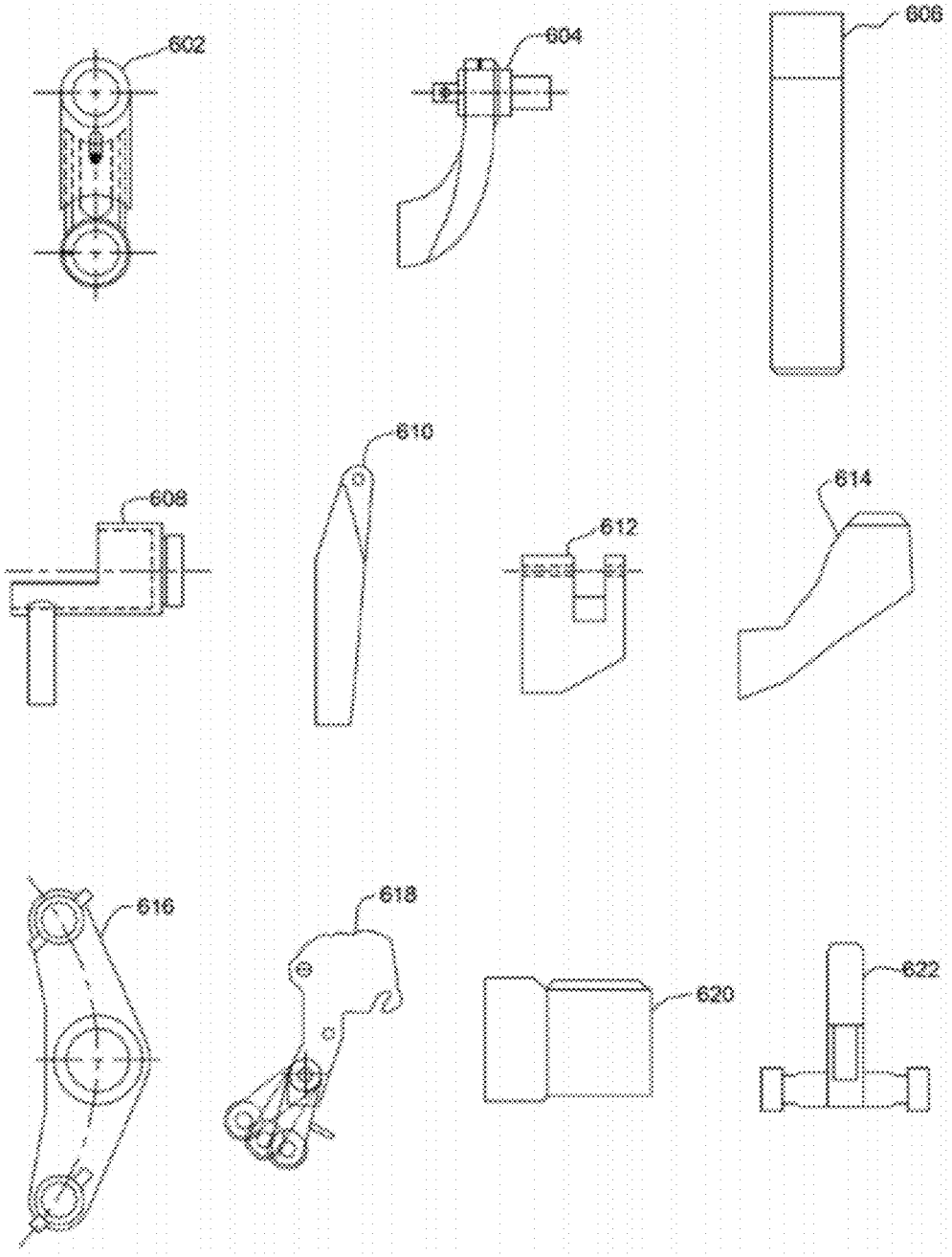
FIG. 6 is a display of commercially available reaction fixtures usable with portions of the reaction adaptor.

These and other alternative structures of portions of first and second elements 160 and 170 envision the use of commercially available and custom manufactured reaction fixtures with or in replacement of portions of first and/or second elements 160 and 170. FIG. 6 is a display of such commercially available reaction fixtures, including: splined, bore and nut, bore and detent, polygonal, bore and pin, hinged and other connecting means. Examples of some of these commercially available and custom manufactured reaction fixtures include: a dual reaction fixture 602; a standard reaction arm 604; an extended collinear reaction arm 606; a tubular reaction fixture 608; an extended reaction arm 610; a reaction pad 612; a cylinder reaction arm 614; a turbine coupling reaction fixture 616; a three position reaction roller 618; a cylinder reaction foot 620; and an extended reaction roller 622. Other commercially available and custom manufactured reaction fixtures exist and may be adapted to use with portions of first and second elements 160 and 170.

Figure 7:
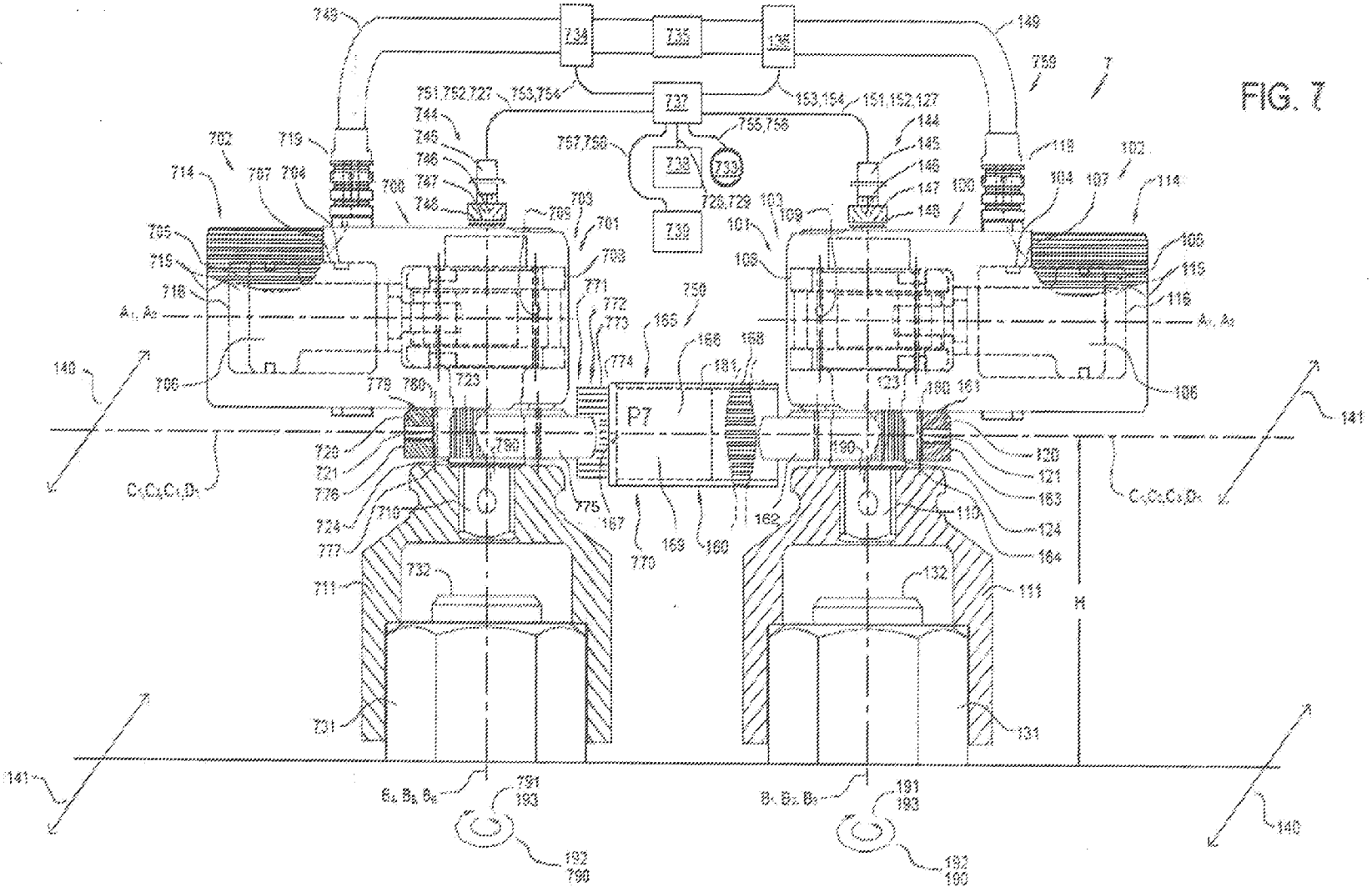
FIG. 7 is a side view of an apparatus for tightening or loosening fasteners having a torque output regulation system.

Alternative Embodiments of the Reaction Adaptor. Generally discussion related to FIGS. 1-6 applies to FIGS. 7 and 8. FIG. 7 is a side view of an apparatus 7 for tightening or loosening fasteners which includes a first and a second receiving member 111 and 711, rotatably supported in apparatus 7, for receiving a first and a second fastener 131 and 731; a first and a second device for effecting rotation of the respective receiving members (i.e., at least portions of a first and a second torque power tool 100 and 700) to tighten or loosen the respective fasteners; and a device for controlling a first and a second torque output level 127 and 727 or other operation parameter of the respective devices for effecting, rotation (i.e., at least portions of a torque output regulation system 759 to maintain a difference in the torque output levels within a predetermined value.

Generally, reaction adaptor 750 includes a first and a second force-transmitting element 160 and 770 engageable with and attachable to tools 100 and 700. Tool 100 produces a first turning force 190 acting about a first turning force axis $B_1$ in one direction 192 during operation. Second tool 700 produces a second turning force 790 acting about a second turning force axis $B_4$ in one direction 192 during operation. First element 160, when attached to first tool 100, receives a first reaction turning force 191 acting in another direction 193 during operation. Second element 770 when attached to second tool 700 receives a second reaction turning force 791 acting in another direction 193 during operation First and second turning forces 190 and 790 turn fasteners 131 and 731.

First and second turning forces 190 and 7 may lie substantially equal to each ether in opposite directions to first and second reaction turning forces 191 and 791. This likely occurs where bolt loads and friction values of fasteners 131 and 731 are similar. Reaction adaptor 150 receives reaction turning forces 191 and 791 in another direction 193, thus substantially negating them. The twisting and fastener-bending forces and least destructive when reaction turning forces 191 and 791 are transferred perpendicular to turning force axes $B_1$ and $B_4$ in plane 140 at ideal abutment pressure point $P_7$. The usual side load; fastener bending, thread galling and bolt damage are reduced or negated. Efficiency and productivity is increased.

As previously discussed, tool 100 includes a housing 101 having two housing portions, a cylinder portion 102 and a driving portion 103. Cylinder-piston means 104 are arranged in cylinder portion 102 and include a cylinder 105, a piston 106 reciprocatingly movable in cylinder 105 along piston axis $A_1$, and a piston rod 107 connected with piston 106. Hydraulic fluid, under pressure, is delivered to tool 100 via a conduit 119 through a fluid supply line 149 from an hydraulic pump 135. A known lever-type ratchet mechanism 108 is arranged in driving portion 103, connected to and drivable by cylinder-piston means 104, and includes a ratchet 109. Ratchet 109 is turnable about turning force axis $B_4$, perpendicular to piston axis $A_1$ and $A_2$. Ratchet 109 is connected with a driving element 110 which receives first turning force 190. First turning force 190 turns hex socket 111 attached to driving element 110 to turn fastener 131.

A reaction support portion 120 connected to driving portion 103 receives first reaction turning force 191. Reaction support portion 120 is formed of annular polygonal body 121 having the plurality of outer splines 123. Outer splines 123 are positioned circumferentially around annular body 121 and extend radially outwardly from central axis $B_2$ which is coaxial with first turning force axis $B_1$.

Tool 700 includes a housing 701 having two housing portions, a cylinder portion 702 and a driving portion 703. Cylinder-piston means 704 are arranged in cylinder portion 702 and include a cylinder 705, a piston 706 reciprocatingly movable in cylinder 705 along a piston axis $A_2$, and a piston rod 707 connected with piston 706. Hydraulic fluid, under pressure, is delivered to tool 700 via a conduit 719 through a fluid supply line 749 from hydraulic pump 135. A known lever-type ratchet mechanism 708 is arranged in driving portion 703, connected to and drivable by cylinder-piston means 704, and includes a ratchet 709. Ratchet 709 is turnable about second turning force axis $B_4$, perpendicular to piston axes $A_1$ and $A_2$ and parallel to first turning force axis $B_1$. Ratchet 709 is connected with a driving element 710 which receives second turning force 790 acting about turning force axis $B_4$. Second turning force 790 turns hex socket 711 attached to driving element 710 to turn fastener 731.

A reaction support portion 720 connected to driving portion 703 receives a second reaction turning force. Reaction support portion 720 is formed of an annular polygonal body 721 having a plurality of outer splines 723. Outer splines 723 are positioned circumferentially around annular body 721 and extend radially outwardly from a central axis $B_5$ which is coaxial with second turning force axis $B_4$.

Reaction adaptor 750 includes first force-transmitting element 160, which when engaged with tool 100 is rotatable about turning force axis $B_1$. Reaction adaptor 150 also includes a second force-transmitting element 770, which when engaged with first element 160 is either rotatable about, extensible and retractable along, or rotatable about and extensible and retractable along at least distal portion 165. Second force-transmitting element 770, when engaged with tool 700, is rotatable about turning force axis $B_4$.

First element 160 includes proximal portion 161 formed of an annular polygonal body 162 having plurality of inner splines 163, and a distal portion 165 formed of a tubular member 166 having an internal bore 167 with a plurality of inner splines 168. Second element 770 includes a proximal portion 771 formed of a tubular member 772 having a plurality of outer splines 773, and a distal portion 775 formed of an annular polygonal body 776 having a plurality of inner splines 777. As shown in FIG. 7, first element 160, when attached to tool 100, extends substantially perpendicular to and has a force-transmitting axis $C_1$, which is substantially perpendicular to turning force axis $B_1$. Second element 770, when attached to tool 700, extends substantially perpendicular to and has force transmitting axis $C_1$ substantially perpendicular to turning force axis $B_2$. First and second elements 160 and 770, when attached to each other, extend substantially collinear to force-transmitting axis $C_1$.

First element 160 is shown non-rotatably attached to reaction support portion 120 in first position and held in place by locking mechanism 180. First element 160 is engageable and attachable separately, individually, and independently to tool 100 and second element 770. Inner splines 163 are positioned circumferentially around the inside of annular body 162 and extend radially inwardly toward central axis $B_3$. Annular body 162 is of such inner width and annular body 121 is of such outer width that inner splines 163 mesh with outer splines 123. Annular body 121 and proximal portion 161 include first and second connecting means 124 and 164. Reaction support portion 120 and first element 160 are attachable to each other by attaching first and second connecting means 121 and 164. Axes $B_1$, and B are coaxial when first element 160 and reaction support portion 120 are attached to each other and to tool 100.

Second element 770 is shown non-rotatably attached to first element 160 in a second position and held in place by a locking mechanism 780. Second element 770 is engageable and attachable separately, individually and independently to first element 160. Inner splines 168 are positioned circumferentially around the inside of internal bore 167 and extend radially inwardly toward a central axis $C_2$. Outer splines 773 are positioned circumferentially around tubular member 772 and extend radially outwardly from a central axis $C_3$. Internal bore 167 is of such inner width and tubular member 772 is of such outer width that inner splines 168 mesh with outer splines 773. Internal bore 167 receives tubular member 772 in a telescoping arrangement. Distal portion 165 includes third connecting means 169 which comprises tubular member 166, internal bore 167, and inner splines 168. Proximal portion 771 includes fourth connecting means 774 which comprises tubular member 772 and outer splines 773. First and second elements 160 and 770 are attachable to each other by attaching third and fourth connecting means 169 and 774 which are held in place by locking mechanism 181. Axes $B_1$, $B_2$, and $B_3$ are substantially coaxial and $C_1$, $C_2$, $C_3$ and $D_1$ are substantially coaxial when tool 100 with reaction support portion 120, first element 160, second element 770 and tool 700 with reaction support portion 720 are attached to each other.

Second element 770 is also shown non-rotatably attached to reaction support portion 720 in second position and held in place by locking mechanism 780. Second element 770 is engageable and attachable separately, individually and independently to tool 700. Inner splines 777 are positioned circumferentially around the inside of annular body 776 and extend radially inwardly toward central axis $B_6$. Annular body 776 is of such inner width and annular body 721 is of such outer width that inner splines 777 mesh with outer splines 723. Annular body 721 and distal portion 775 include fifth and sixth connecting means 724 and 779. Reaction support portion 720 and second element 770 are attachable to each other by attaching fifth and sixth connecting means 724 and 779. Axes $B_4$, $B_5$, and $B_6$ are coaxial when second element 770 and reaction support portion 720 are attached to each other and to tool 700.

An operation parameter regulation system 759 is shown exterior to pump 735, however the whole of system 759 or parts thereof may be found within pump 735. Operation parameter regulation system 759 regulates torque outputs of tools 100 and 700. Torque output regulation system 759 includes a first and a second switch 734 and 736 attached to hydraulic pump 735 and pressurized fluid supply lines 149 and 749. Switches 734 and 736 are activated by a control system 737, which controls torque output levels 127 and 727 of tools 100 and 700 to maintain a difference in the torque output levels within a predetermined torque difference value 758. Switches 734 and 736 may include: pushbutton, rocker, toggle, rotary coded DIP, rotary DIP, key lock, slide, snap action or reed switches; or air, back flow preventer, ball, butterfly, check, control, diverter, drain, shut-off, gas, gas-pressure, globe, hydraulic regulator, hydraulic, mixing, needle, pinch, plug, pressure regulator, pressure relief, servo, shut-off, slide, poppet or solenoid valves. If an electric motor is used, switches 734 and 736 may include any of the above electrical control switches.

Torque output regulation system 759 may include torque transducers such as a first and a second ferromagnetic sensor 144 and 744. Ferromagnetic sensors 144 and 744 include: couplings 145 and 745 for connection to control system 737; stationary Hall effect or similar magnetic field sensing units 146 and 746; and ferromagnetic parts 148 and 748 coupled to tools 100 and 700. Note that other components known in the art may be used.

Ferromagnetic sensors 144 and 744 measure torque output levels 127 and 727 of tools 100 and 700. A first and a second conduit 151 and 751 carry a first and a second torque data signal 152 and 752 including output torque levels 127 and 727 to control system 737. A conduit 757 carries input data 758 from an input device 739 to control system 737. A conduit 728 carries an output data 729 to an output device 738. A conduit 755 carries power 756 from a power supply 733 to control system 737. Power supply 733 may be any suitable source (e.g., battery, solar cell, fuel cell, electrical wall socket, generator, motor, etc.). Input device 739 may be any suitable device (e.g., touch screen, keypad, mouse, remote, etc.). An operator may input a predetermined torque difference value, input data 758, into input device 739. Predetermined torque difference value 758 is carried through conduit 757 to control system 737. Control system 737 may transmit output data 729 through conduit 728 to output device 738. Output data 729 may include predetermined torque difference value 758 and/or torque output levels 127 and 727 from tools 100 and 700. Output device 738 may be any suitable device (e.g., screen, liquid crystal display, etc.). Control system 737 may send switch control signals 154 and 754 through conduits 153 and 753 to switches 734 and 136.

Torque output regulation system 759 may monitor torque output levels 127 and 727 by any of the following operation parameters (i.e. torque data signals 152 and 752) including: hydraulic or pneumatic fluid pressures or flow rates; electrical circuit parameters such as current, voltage or magnetic field; direct measurement of torque output; or a combination of such. These operation parameters may be measured or sensed by various types of: strain gauges; rotary encoders; torque sensors; clutches; load cells; or position, flow, force or pressure meters, sensors or valves. Note that other components known in the art may be used. For example, clutches may be configured to slip respectively to maintain the difference in the torque output levels within the predetermined torque difference value 758.

Apparatus 7 operates by activating pump 735 and control system 737 to regulate torque output levels 127 and 727. The difference in torque output levels 127 and 727 may exceed predetermined torque difference value 758. If so control system 737 regulates torque output levels 127 and 727 of tools 100 and 700 by either: lowering the torque output level of the tool with the higher torque output level; raising the torque output level of the tool with the lower torque output; or both raising and lowering the torque output levels of the tools until the difference in the torque output levels returns to within the predetermined torque difference value.

Figure 8:
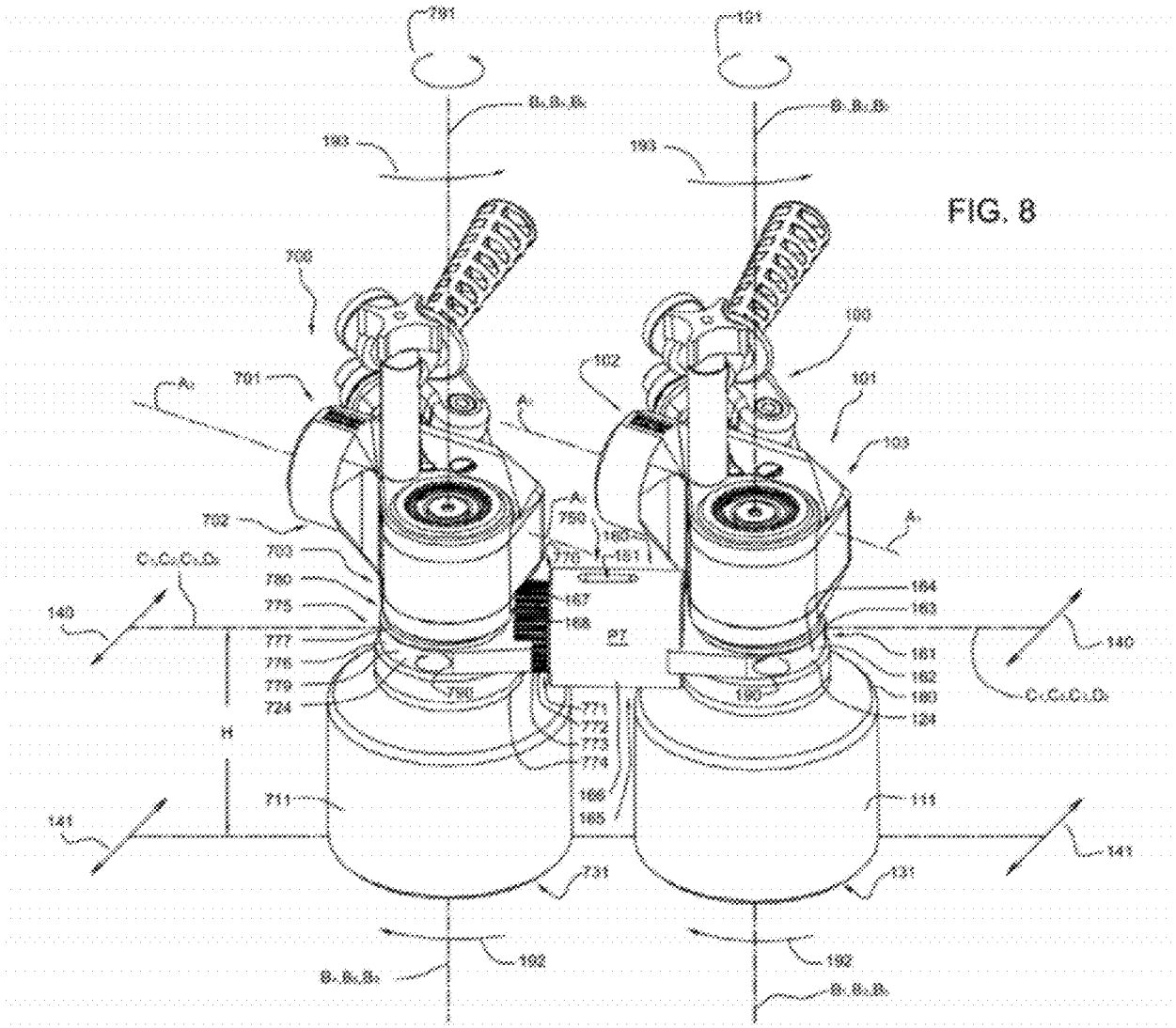
FIG. 8 is a three-dimensional view of apparatus of FIG. 7.

FIG. 8 is a three-dimensional view of portions of FIG. 7. Tools 100 and 700 are prepared to turn fasteners 131 and 731 threaded on lugs 132 and 732 to connect plates of a flange. Reaction adaptor 750 is attached to tools 100 and 700 in a reaction force transfer position to transfer reaction turning forces 191 and 791 to ideal abutment pressure point $P_7$. Turning forces 190 and 790, acting in the clockwise one direction 192, turn hex sockets 111 and 711 on fasteners 131 and 731. And first and second elements 160 and 770 of reaction adaptor 750 receive reaction turning forces 191 and 791, acting in the counterclockwise another direction 193. This prevents ratchets 109 and 709 from rotating inwardly relative to fasteners 131 and 731, which are turned to a desired torque.

A method of using the apparatus may include: an operator inputs predetermined torque difference value 758 into input device 739; output device 738 displays predetermined torque difference value 758; the operator activates tools 100 and 700; control system 737, using ferromagnetic sensors 144 and 744, measures torque output values 127 and 727 and maintains a difference in the torque output values 127 and 727 within predetermined torque difference value 758. If the difference in the torque output values 127 and 727 exceeds the predetermined torque difference value 758, control system 737 either: lowers the torque output level of the tool with the higher torque output level; raises the torque output level of the tool with the lower torque output; or both raises and lowers the torque output levels of the tools until the difference in the torque output levels returns to within predetermined torque difference value 758.

The following discussion relates to alternative embodiments of apparatus 7. Note that for ease of discussion, the components are referenced in the plurality but alternatively may be in the singular.

The receiving members commonly known in the art as 'sockets', receive at least a portion of the fasteners. The receiving members are shaped so that they correspond to the shape of at least a portion of the fasteners. Once such a portion is received, it and the receiving member are rotationally fast with each other. It will be appreciated by those skilled in the art that there are many shapes that a fastener may be, and an appropriately shaped receiving member must be selected for use with a particular fastener. Thus the receiving members may be removably connectable to the devices for effecting rotation to permit interchangeability of differently shaped receiving members.

The devices for controlling may include clutches which are configured to slip to maintain the difference in the torque output levels or other operation parameters within the predetermined value. The devices for sensing operation parameters may be in the form of angle or rotary encoders which send signals to the devices for effecting rotation. In use, the respective devices for effecting rotation either maintain, slow, stop, or speed up to regulate the difference in the torque output levels to within the predetermined value. Such a dutch mechanism may selectively couple and uncouple the cylinder and driving or other related portions of the respective tools. An actuator, operated by pressure of a working medium for pressing the dutch mechanism into engagement so that a torque can be transferred from the driving shaft to the driven shaft, would be needed. A control unit for controlling the pressure of the working medium supplied to the actuator clutch and for stopping the motor when the actuator dutch is disengaged and a working medium source for supplying the working medium to the actuator dutch would also be needed.

Note that other operation parameters may be used to regulate the apparatus including: hydraulic or pneumatic fluid pressures or flaw rates; electrical circuit parameters such as current, voltage or magnetic field; rotation speeds of the devices for effecting rotation of the respective receiving members; or a combination of such. If the difference in the operation parameters exceed the predetermined value the device for controlling regulates the operation parameter of the respective devices for effecting rotation by either; lowering the operation parameter of the device with the higher operation parameter; raising the operation parameter of the device with the lower operation parameter; or both raising and lowering the operation parameter of the respective devices until the difference in the operation parameters returns to within the predetermined value.

Note that other regulation methods may be used, including turning the tools on and off manually or at a fixed or variable frequency until the difference in the operation parameters returns to within the predetermined value.

In another embodiment of the apparatus of the present invention motors, current detecting means and rotation angle detection means may be used. The current detecting means (e.g., an ammeter) senses current flowing to the motors and the rotation angle detecting means (e.g. a rotary encoder) senses relative rotation angles of the devices for effecting rotation. The device for controlling regulates the devices for effecting rotation to maintain the difference between the operation parameters within the predetermined value.

An operator may manage the apparatus of the present application by a device for managing the tightening or loosening of the fasteners. The device for managing may include a microcomputer having a CPU, a ROM, a RAM and an I/O. The ROM of the microcomputer stores a control program to automatically maintain the difference in the torque outputs or other operation parameters within a predetermined value. The device for managing may further include a memory. Note that an operator may set and store in the memory preset ranges of hydraulic or pneumatic fluid pressures or flow rates, electrical circuit parameters such as current, voltage or magnetic field, torque output, rotation speeds, a combination of such; or other parameters disclosed or known in the art.

The components of the device for managing and the apparatus in general may be connected communicably to each other. The memory of the management system may store the determination result transmitted from the communicating means. It should be appreciated that a plurality of management tasks may be performed, including: the simultaneous tightening or loosening of a plurality of fasteners; the simultaneous testing of a plurality of fasteners; determining the normality of tightening or loosening of the fasteners; storing of data of tightening, loosening and testing operations over a range of operation periods; and determining the extent of wear of components of the tightening and testing apparatus; etc.

Another embodiment of the apparatus may include a reaction adaptor and/or a reaction hub to tighten or loosen a plurality of fasteners.

Alternative Embodiments of the Placement and Quantity of the Reaction Adaptor. Tool 100 may have a first and a second reaction adaptor. Generally discussion related to FIGS. 1-8 applies to this embodiment. The second reaction adaptor, similar to first reaction adaptor 150, has a third force-transmitting element, when engaged with tool 100, being rotatable about a piston axis of the tool; and a fourth force-transmitting element, when engaged with the third element, being either rotatable about, extensible and retractable along, and rotatable about and extensible and retractable along at least a distal portion of the third element.

Figure 9:
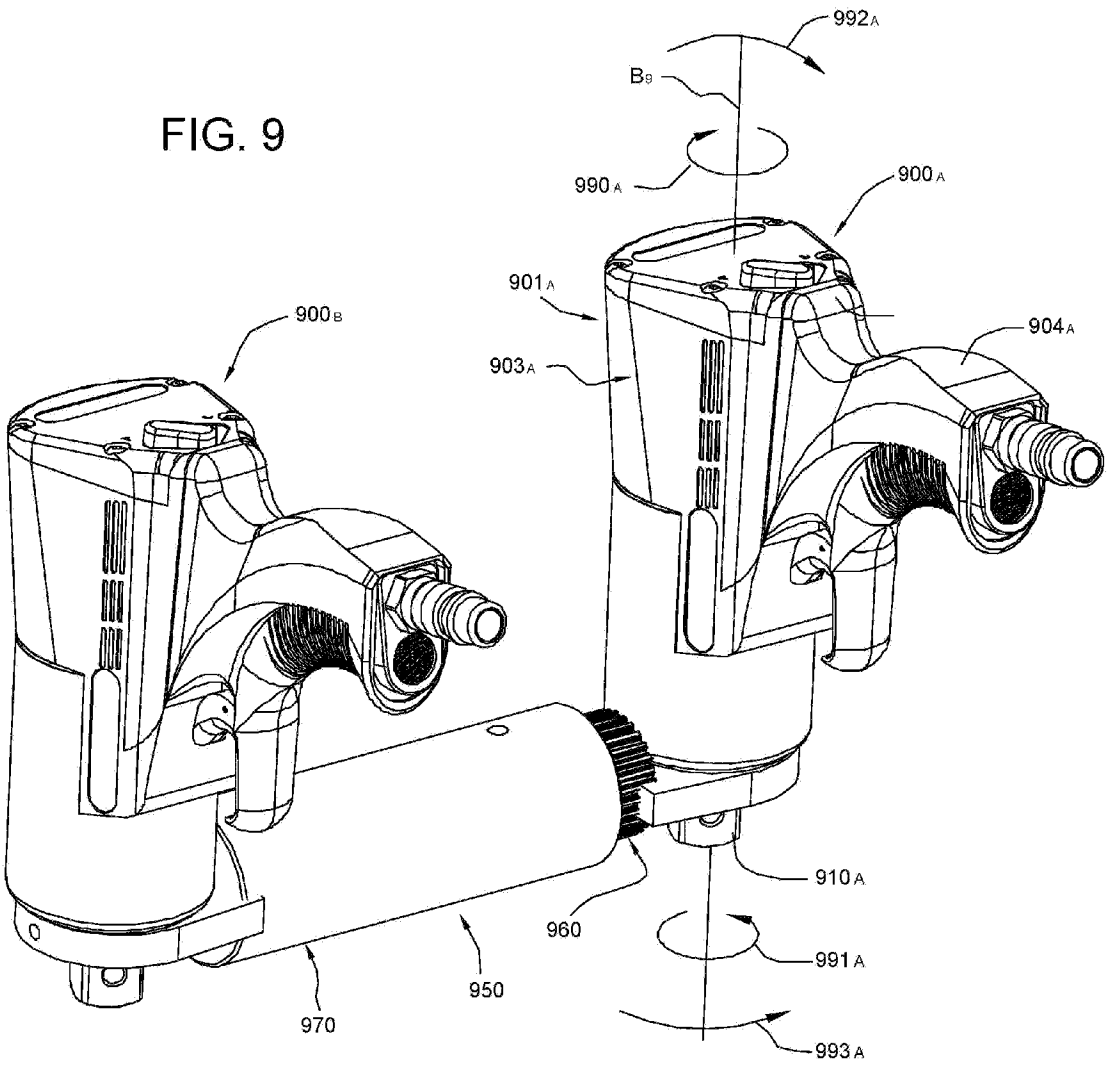
FIG. 9 is a three-dimensional view of a first and a second pneumatically, electrically, hydraulically or manually driven torque power tool attached by a reaction adaptor.

Alternative Types of Tools Which May Utilize the Reaction Adaptors. Torque power tools are known in the art and include those driven pneumatically, electrically, hydraulically, manually, by a torque multiplier, or otherwise powered. FIG. 9 shows a first hand-held torque power wrench $\mathbf{900}_A$ and a second hand-held torque power wrench $\mathbf{900}_B$ attached by a reaction adaptor 950, similar to that of reaction adaptor 750. First wrench $\mathbf{900}_A$ has a housing $\mathbf{901}_A$ which accommodates a motor $\mathbf{902}_A$ driven pneumatically, electrically, hydraulically, manually, by a torque multiplier, or otherwise powered. Motor $\mathbf{902}_A$ produces a turning force $\mathbf{990}_A$ acting about a turning force axis $B_9$ in one direction $\mathbf{992}_A$ which turns driving element $\mathbf{910}_A$ and provides rotation of a corresponding fastener. First wrench $\mathbf{900}_A$ may be provided with torque intensifying means (not shown) for increasing a torque output from motor $\mathbf{902}_A$ to driving element $\mathbf{910}_A$. The torque intensifying means may be formed as planetary gears which are located in housing $\mathbf{901}_A$. Generally discussion related to first wrench $\mathbf{900}_A$ applies to second wrench $\mathbf{900}_B$. Generally discussion related to reaction adaptor 750 applies to reaction adaptor 950.

Figure 10:
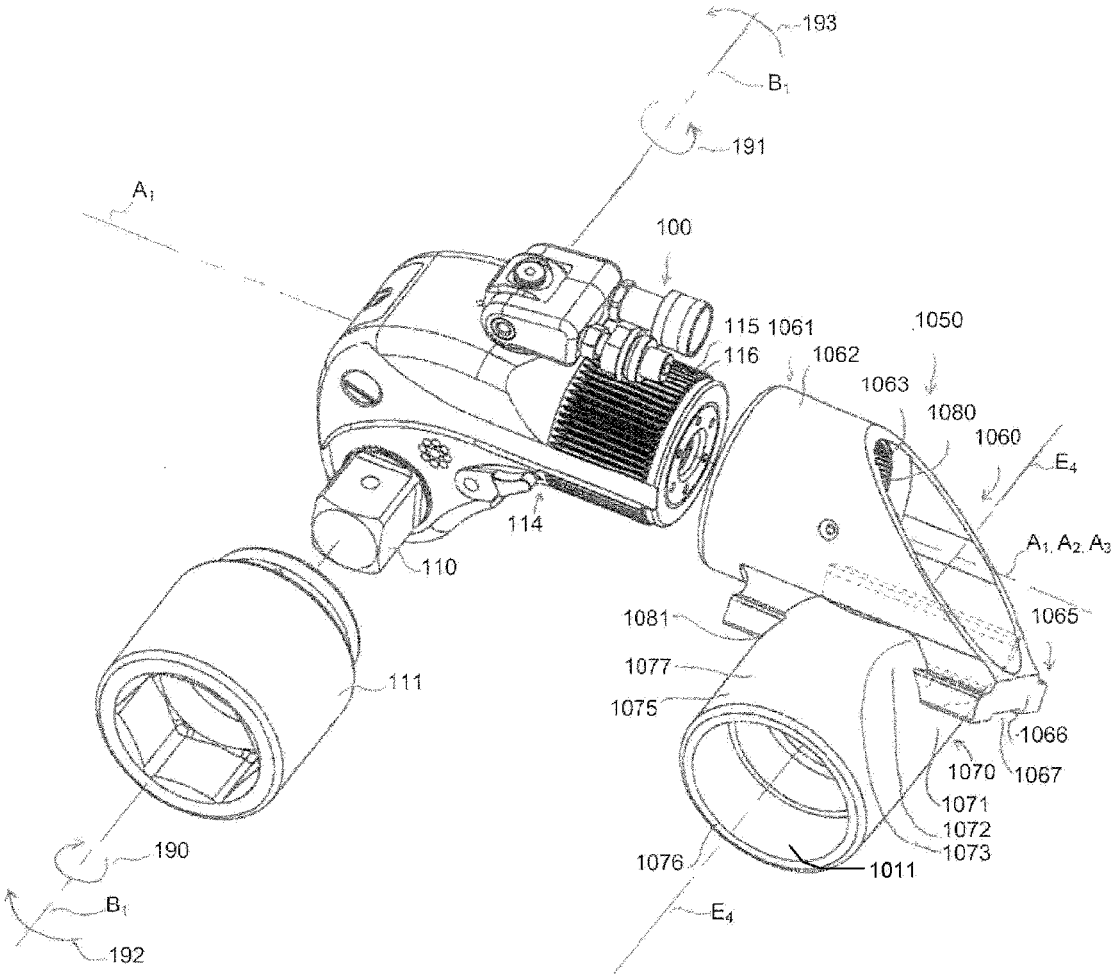
FIG. 10 is a three-dimensional view of another exemplary embodiment of a reaction adaptor for the tool.

Further Embodiments. FIG. 10 shows a three-dimensional perspective view of tool 100 with a reaction adaptor 1050, an alternative embodiment of reaction adaptors of the present application. Generally all previous discussion applies to FIG. 10. Tool 100 tightens or loosens a fastener (not shown) during operation. Reaction adaptor 1050 transfers reaction force 191 to another fastener (not shown). It has a first force-transmitting element 1060 attachable to reaction support portion 114; a second force-transmitting element 1070 slidably attachable to first element 1060; and second element 1070 has a receiving member 1011 for receiving the other fastener.

First element 1060 includes a proximal portion 1061 formed of an annular polygonal body 1062 having a plurality of inner splines 1063, and a distal portion 1065 formed of a polygonal body 1066 having a substantially T-shaped track plate 1067. Second element 1070 includes a proximal portion 1071 formed of a polygonal body 1072 having a substantially C-shaped track plate 1073, and a distal portion 1075 formed of a cylindrical body 1076. First element 1060, when attached to reaction support portion 114, extends substantially collinear to and has a first force-transmitting axis $A_5$ substantially collinear to piston axis $A_1$. Second element 1070, when attached to first element 1060, extends substantially perpendicular to and has a second force-transmitting axis $E_4$ substantially perpendicular to first force-transmitting axis $A_5$.

First element 1060 is shown rotatably engaged with reaction support portion 114 in a first position. Note that reaction support portion 114 is away from turning force axis $B_1$ and reaction support portion 120. First element 1060 may be non-rotatably attached to reaction support portion 114 in numerous positions and held in place by a locking mechanism 1080 (not shown). Locking mechanism 1080 may include a bore and pin or other well known configuration like a spring loaded reaction clamp, a catch lever assembly or a fixed link pin with snap rings. First element 1060 is engageable and attachable separately, individually, and independently to tool 100. Inner splines 1063 are positioned circumferentially around the inside of annular body 1062 and extend radially inwardly toward central axis $A_2$. Annular body 1062 is of such inner width and annular body 115 is of such outer width that inner splines 1063 mesh with outer splines 116. Annular body 115 and proximal portion 1061 are part of additional connecting means. Reaction support portion 114 and first element 1060 are attachable to each other by attaching the additional connecting means. Axes $A_1$, $A_2$, and $A_5$ are substantially coaxial when first element 1060 and reaction support portion 114 are attached to each other and to tool 100.

Note that reaction support portion 114 has a height such that first element 1060, when engaged with tool 100, may be slid along reaction support portion 114. In this variation, annular body 1062 may also have a height such that first element 1060 is extensible and retractable along reaction support portion 114.

Second element 1070 is shown slideably attached to first element 1060 in a second position and held in place by a locking mechanism 1081 (not shown). Locking mechanism 1081 may include a bore and pin or other well known configuration like a spring loaded reaction clamp, a catch lever assembly or a fixed link pin with snap rings. Additionally a set screw may be used to hold first element 1060 in place. Second element 1070 is engageable and attachable separately, individually, and independently to first element 1060. T-shaped track plate 1067 and C-shaped track plate 1073 are both complementary and of such dimensions that they mesh to form a slideable T&C connector. Note that other connector shapes may be used.

The hex socket and reaction adaptor 1050 are shown disassembled from tool 100. Tool 100 turns the fastener and reaction adaptor 1050 transfers reaction force 191 to the other fastener at an abutment pressure point during operation. Distal portion 1075 extends downward, substantially perpendicular to first element 1060 and receives the other fastener. Cylindrical body 1076 bears against the abutment pressure point on the walls of the other fastener as turning force 190 turns the hex socket on the fastener. This prevents the ratchet from rotating inwardly relative to the fastener. Thus the fastener is turned by the hex socket to a desired torque.

Driver 110 may rotate different fastener engagement means 111 depending on the fastener to be turned including: alien key; castellated or impact socket driver; hex reducer; square drive adaptor; or any other reasonable geometry or configuration. Similarly receiving member 1077 may be round, square, hexagonal or any reasonable geometry or configuration, depending on the fastener which absorbs reaction force 191. Receiving member 1077 may surround, engage or abut the other fastener. Receiving member 1077 may surround, engage or abut other structures to achieve an ideal abutment pressure point. Further receiving member 1077 either may be an abutment portion, polygonal or otherwise, a socket, an alien key or another type of fastener engagement means. Both tool 100 and reaction adaptor 1050 may include a tool pattern for mounting a handle for an operator.

Generally discussion related to the method of FIG. 4 applies to FIG. 10. In step 412 of FIG. 4, second element 1070 is engaged with first element 1060 by bringing proximal portion 1071 substantially adjacent to distal portion 1065 and substantially aligning T-shaped track plate 1067 and C-shaped track plate 1073 to form a slideable T&C connector.

Tool 100 is prepared to turn the fastener about turning force axis $B_1$ with turning force 190 in the one direction 192. In step 414 of FIG. 4, tool 100 is positioned to receive the other fastener by sliding second element 1070 along distal portion 1065 to an extension length which corresponds to the proximity of the other fastener. In step 416 of FIG. 4, second element 1070 is attached to first element 1060 in the second position by activating locking mechanism 1081. Reaction adaptor 1050 is now in reaction force transfer position. In steps not shown in FIG. 4, socket 111 is attached to the driving element, and tool 100 is placed on the fastener to be turned.

Advantageously, first element 1060 is engageable and attachable separately, individually and independently to tool 100 and second element 1070 is engageable and attachable separately, individually and independently to first element 1060. Portability of tool 100 is maximized while weight of tool 100 is minimized. Commercially available reaction fixtures may be used with or in replacement of portions of first and second elements 1060 and 1070, rather than custom reaction fixtures, thereby reducing costs and increasing safety. Reaction adaptor 1050 is adjustable to minimize twisting and fastener-bending forces so as to avoid tool 100 from jumping off of the job or from failing. Reaction adaptor 1050, when engaged with tool 100, is adjustable to surround, engage or abut against viable fasteners or stationary objects at the ideal abutment pressure point. Reaction adaptor 1050, when attached to tool 100, transfers reaction force 191 to the ideal abutment pressure point during operation. Operators no longer need several tools at the workstation each having a reaction fixture oriented differently to abut against viable stationary objects for each application. Nor do operators need to completely disassemble tool 100, reposition reaction adaptor 1050 and reassemble tool 100 for each application.

Figure 11:
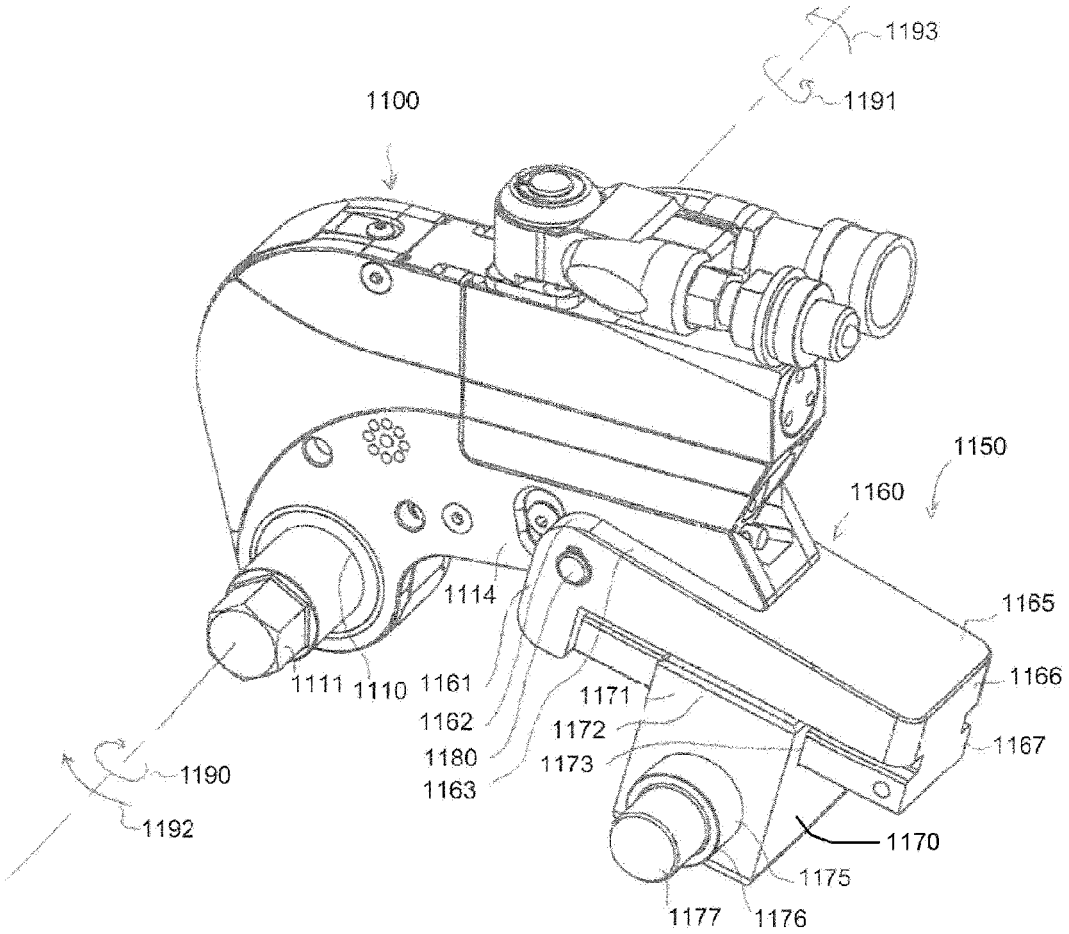
FIG. 11 is a three-dimensional view of another exemplary embodiment of a reaction adaptor for another tool.

FIG. 11 shows a three-dimensional perspective view of a tool 1100 with a reaction adaptor 1150, alternative embodiments of tools and reaction adaptors of the present application. Tool 1100 may be a limited clearance hydraulic torque multiplier and/or tension tool. Generally all previous discussion applies to FIG. 11.

Tool 1100, as configured, tightens or loosens a fastener (not shown), likely an alien bolt, during operation. A driver 1110 may rotate different fastener engagement means 1111 depending on a fastener to be turned including: alien; castellated or impact socket driver; hex reducer; square drive adaptor; or any other reasonable geometry or configuration.

Reaction adaptor 1150, transfers reaction force 1191 to another fastener (not shown). It has a first force-transmitting element 1160 attachable to a reaction support portion 1114; a second force-transmitting element 1170 slideably attachable to first element 1160; and second element 1170 has receiving member 1177 for receiving the other fastener.

First element 1160 includes a proximal portion 1161 formed of a polygonal body 1162 having a recess or removed portion 1163, and a distal portion 1165 formed of a polygonal body 1166. A substantially T-shaped track plate 1167 runs along first element 1160 encompassing most of proximal portion 1161 and all of distal portion 1166. Second element 1170 includes a proximal portion 1171 formed of a polygonal body 1172 having a substantially C-shaped track plate 1173, and a distal portion 1175 formed of a polygonal or cylindrical body 1176 with a receiving member 1177. First element 1160, when attached to tool 1100, extends the length of reaction support portion 1114. In this example, first element 1160 extends from reaction support portion 1114 such that first element 1160 extends substantially at an angle of 135° to reaction support portion 1114. Receiving member 1177 is substantially coplanar with driver 1110. First element 1160 may substantially extend at an angle of 45°-180° to reaction support portion 114 and have a first force-transmitting axis substantially along itself. Second element 1170, when attached to first element 1160, extends substantially perpendicular to and has a second force-transmitting axis substantially perpendicular to the first force-transmitting axis.

First element 1160 is shown attached to reaction support portion 1114 in a first position. Note that reaction support portion 1114 is away from the turning force axis. First element 1160 may be attached to reaction support portion 1114 in numerous user chosen positions and held in place by a locking mechanism 1180 (not shown). Locking mechanism 1180 may include a bore and pin or other well known configuration like a spring loaded reaction clamp, a catch lever assembly or a fixed link pin with snap rings. Additionally a set screw may be used to hold first element 1160 in place. First element 1160 is engageable and attachable separately, individually, and independently to tool 1100. Recess 1163 receives part of reaction support portion 1114, both of which are part of additional connecting means. Reaction support portion 1114 and first element 1160 are attachable to each other by attaching the additional connecting means. First element 1160, when engaged with tool 1100, may be slid along reaction support portion 1114 depending on the length of first element 1160 and the angle and length of recess 1163.

Second element 1170 is shown slideably attached to first element 1160 in a second position. Second element 1170 is engageable and attachable separately, individually, and independently to first element 1160. T-shaped track plate 1167 and C-shaped track plate 1173 are both complementary and of such dimensions that they mesh to form a slideable T&C connector. Note that other connector shapes may be used.

Receiving member 1177 may be round, square, hexagonal or any reasonable geometry or configuration, depending on the other fastener, the fastener which absorbs reaction force 1191. Receiving member 1177 may surround, engage or abut the other fastener. Receiving member 1177 may surround, engage or abut other structures to achieve an ideal abutment pressure point. Further receiving member 1177 either may be an abutment portion, polygonal or otherwise, a socket, an alien key or another type of fastener engagement means. Both tool 1100 and reaction adaptor 1150 may include a tool pattern for mounting a handle for a user.

Advantageously, first element 1160 is engageable and attachable separately, individually and independently to tool 1100 and second element 1170 is engageable and attachable separately, individually and independently to first element 1160. Portability of tool 1100 is maximized while weight of tool 1100 is minimized. Commercially available reaction fixtures may be used with or in replacement of portions of first and second elements 1160 and 1170, rather than custom reaction fixtures, thereby reducing costs and increasing safety. Reaction adaptor 1150 is adjustable to minimize twisting and fastener-bending forces so as to avoid tool 1100 from jumping off of the job or from failing. Reaction adaptor 1150, when engaged with tool 1100, is adjustable to surround, engage or abut against viable fasteners or stationary objects at the ideal abutment pressure point. Reaction adaptor 1150, when attached to tool 1100, transfers reaction force 1191 to the ideal abutment pressure point during operation. Operators no longer need several tools at the workstation each having a reaction fixture oriented differently to abut against viable stationary objects for each application. Nor do operators need to completely disassemble tool 1100, reposition reaction adaptor 1150 and reassemble tool 1100 for each application.

Combinations and Variations of All Embodiments and Modes. Combinations and variations of all of embodiments and modes discussed in relation to FIGS. 1-11 may find useful applications. In one combination and variation, for example, a tool similar to tool $\mathbf{900}_A$ is attached to a tool similar to tool 100 by a first reaction adaptor similar to reaction adaptors 750 and/or 950 and a second reaction adaptor similar to reaction adaptor 850 is attached to tool 100 at reaction support portion 114. In another combination and variation, for example, a first and a second tool similar to tool $\mathbf{900}_A$ and a third and a fourth tool similar to tool 100 are attached to a reaction hub by a first, a second, a third and a fourth reaction adaptor similar to reaction adaptors 750 and/or 950. Further, a fifth and a sixth tool similar to tool 100 are attached to the third and fourth tools by a fifth and a sixth reaction adaptor similar to reaction adaptors at the reaction support portions of tools. In such combinations and variations, a plurality of tool types may be used with a plurality of reaction adaptor and hub types. In additional combination and variations, multiple force-transmitting elements may be utilized by reaction adaptors similar to reaction adaptors 150, 350, 750, 950, 1050, 1150 and the reaction hub and by tools similar to tools 100 and 900. Indeed, elaborate and complex tool, reaction adaptor and force-transmitting elements, etc. combinations may be utilized as the need arises. Note that discussion related to FIGS. 7 and 8 are applicable to these combinations and variations of all embodiments and modes.

Miscellaneous Information. Reaction adaptors, tools, and other force-transmitting components of the present application may be made from any suitable material such as aluminum, steel, or other metal, metallic alloy, or other alloy including non-metals. Tools of the present application may have: load bolt sizes from ½ in. to 8 in.; have drive sizes from ½" to 8 in; have hex sizes from ½" to 8"; have torque output ranges of 100 ft. lbs. to 40,000 ft. lbs; bolt load ranges of 10,000 lbs.-1,500,000 lbs.; and have operating pressures from 1,500 psi to 10,000 psi. Tools of the present application may include Tension, Torque-Tension, and Torque machines, and may include those driven pneumatically, electrically, hydraulically, manually, by a torque multiplier, or otherwise powered. Dimensions of reaction adaptors of the present application may range from 3 in.×1 in.×2.5 in. to 24 in.×8 in.×24 in and weigh from 3 lbs. to 500 lbs. Dimensions of tools of the present application may range from 6 in.×2 in.×5 in. to 23 in.×12 in.×14 in. and weigh from 3 lbs. to 500 lbs. Note that reaction adaptors and tools of the present application may substantially diverge, both positively and negatively from these representative ranges of dimensions and characteristics.

Note that reaction adaptors and apparatus of the present application be used with different types of fasteners including screws, studs, belts, stud and nut combinations, bolt and nut combinations, alien bolts, and any other geometries and configurations of fasteners known in the art. Further fasteners may have engagement means which protrude from, are flush with or are recessed from its end face, or are shaped as caps, discs, cups, tool engagement means, feet, and other rotatable structures of varying dimensions and geometries.

Final Comments Reaction adaptors for torque power tools pneumatically, electrically, hydraulically and manually driven, tools having the adaptors, and methods of using the same, are disclosed. In one example, an apparatus for tightening or loosening fasteners includes: a receiving member, rotatably supported in the apparatus for tightening or loosening, for receiving the fastener; a device for effecting rotation of the receiving member to tighten or loosen the fastener; and an apparatus which transfers a reaction force during tightening or loosening of the fasteners. The apparatus which transfers a reaction force includes: a first force-transmitting element rotatably attachable about a turning force of the device for effecting rotation; and a second force-transmitting element either rotatably attachable about, extensibly and retractably attachable along, or rotatably attachable about and extensibly and retractably attachable along at least a distal portion of the first element.

In a second example, an apparatus for tightening or loosening fasteners includes: a receiving member, rotatably supported in the apparatus for tightening or loosening, for receiving the fastener; a device for effecting rotation of the receiving member to tighten or loosen the fastener; and an apparatus which transfers a reaction force during tightening or loosening of the fastener. The apparatus which transfers the reaction force includes: a first force-transmitting element attachable to a reaction support portion of the apparatus for tightening or loosening; a second force-transmitting element slideably attachable to the first element; and wherein the first and second elements, adjustable to abut against a stationary object, transfer a reaction force during operation.

In a third example, an apparatus for tightening or loosening fasteners includes: a receiving member, rotatably supported in the apparatus for tightening loosening, for receiving the fastener; a device for effecting rotation of the receiving member to tighten or loosen the fastener; and an apparatus which transfers a reaction force during tightening or loosening of the fastener. The apparatus which transfers the reaction force includes: a first force-transmitting element attachable to a reaction support portion of the device for effecting rotation; a second force-transmitting element attachable to at least a portion of the first element, either: rotatably about; extensibly and retractably along; sildeably on; rotatably about, and extensibly and retractably along; rotatably about, and slideably on; or extensibly and retractably along, and slideably on.

In a fourth example, an apparatus for tightening or loosening fasteners includes: first and second receiving member, rotatably supported in the apparatus for tightening or loosening, for receiving a first and a second fastener; a first and a second device for effecting rotation of the respective receiving members to tighten or loosen the respective fasteners; and a device for controlling an operation parameter of each device for effecting rotation to maintain a difference between the operation parameters within a predetermined value.

When used in this specification and claims, the terms "comprises", "includes" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilized for realizing the invention in diverse forms thereof.

It is to be understood that the above is merely a description of preferred embodiments of the present application and that various changes, combinations, alterations, and variations may be made without departing from the true spirit and scope of the invention as set for in the appended claims. The reaction adaptors for torque power tools, tools having the adaptors, and methods of using the same of the present application are described in relation to fasteners and connectors as examples. However, the reaction adaptors for torque power tools, tools having the adaptors, and methods of using the same are viable for use in other residential, commercial, and industrial applications, as well as other devices all together. Few if any of the terms or phrases in the specification and claims have been given any special meaning different from their plain language meaning, and therefore the specification is not to be used to define terms in an unduly narrow sense.

What is claimed is:

1. An apparatus for tightening or loosening fasteners including:

a first and a second receiving member, rotatably supported in the apparatus, for receiving a first and a second fastener;

a first and a second receiving member a first and a second device realized as a first and a second torque power tool either pneumatically, electrically or hydraulically driven for effecting rotation of the respective receiving members to tighten or loosen the respective fasteners;

a device for controlling an operation parameter of each device for effecting rotation to maintain a difference between the operation parameters within a predetermined value, the operation parameters including either:

hydraulic and/or pneumatic fluid pressures;

hydraulic and/or pneumatic fluid flow rates;

electrical circuit parameters including current, voltage and/or magnetic field;

torque output values;

fastener rotation speeds; or any combination thereof;

wherein during operation if the difference in the maintained operation parameter(s) exceeds the predetermined value the device for controlling regulates the maintained operation parameter(s) of the respective devices for effecting rotation by either:

lowering the maintained operation parameter(s) of the device with the higher maintained operation parameter(s);

raising the maintained operation parameter(s) of the device with the lower maintained operation parameter(s); or both raising and lowering the maintained operation parameter(s) of the respective devices;

until the difference in the maintained operation parameter(s) returns to within the predetermined value;

characterized in that the devices for effecting rotation are connected by a connector including:

a first force-transmitting element rotatably attachable about a turning force axis of the first device for effecting rotation;

a second force-transmitting element rotatably attachable about a turning force axis of the second device for effecting rotation; and wherein the second force-transmitting element is either rotatably attachable about, extensibly and retractably attachable along, or rotatably attachable about and extensibly and retractably attachable along at least a distal portion of the first force-transmitting element.

2. An apparatus according to claim 1 wherein the device for controlling includes a device for sensing the operation parameter.

3. An apparatus according to claim 1 wherein the operation parameter is torque output and wherein during operation if the difference in the torque outputs exceed the predetermined value the device for controlling regulates the torque output of the respective devices for effecting rotation by either lowering torque output of the device with the higher torque output, raising the torque output of the device with the lower torque output or both raising and lowering the torque outputs of the respective devices until the difference in the torque outputs returns to within the predetermined value.

4. An apparatus according to claim 1 wherein the devices for effecting rotation simultaneously tighten or loosen the fasteners.

5. An apparatus according to claim 1 wherein a first and a second reaction turning force of the first and the second devices for effecting rotation are substantially negated.

6. An apparatus according to claim 1 including a device for managing the tightening or loosening of the fasteners including a device for communicating between with the devices for effecting rotation and the device for controlling.

7. An apparatus according to claim 1 wherein the first and second receiving members, the first and second elements and/or the first and second devices are attachable to each other separately, individually and independently.

* * * * *